US010525304B2

(12) United States Patent
Kim et al.

(10) Patent No.: US 10,525,304 B2
(45) Date of Patent: Jan. 7, 2020

(54) METHOD FOR DETECTING INFORMATION OF EXERCISE AND ELECTRONIC DEVICE THEREOF

(71) Applicant: SAMSUNG ELECTRONICS CO., LTD., Suwon-si, Gyeonggi-do (KR)

(72) Inventors: Hyungsoon Kim, Goyang-si (KR); Anthony Chien-der Lee, Seoul (KR); Donghyun Lee, Yongin-si (KR); Jaesung Lee, Seongnam-si (KR); Konstantin Pavlov, Moscow (RU); Duarte Joaquin Sanchez, Seoul (KR); Duseon Oh, Suwon-si (KR); Younghyun Kim, Suwon-si (KR)

(73) Assignee: SAMSUNG ELECTRONICS CO., LTD., Suwon-si, Gyeonggi-do (KR)

( * ) Notice: Subject to any disclaimer, the term of this patent is extended or adjusted under 35 U.S.C. 154(b) by 203 days.

(21) Appl. No.: 15/852,533

(22) Filed: Dec. 22, 2017

(65) Prior Publication Data

US 2018/0178059 A1 Jun. 28, 2018

(30) Foreign Application Priority Data

Dec. 28, 2016 (KR) ..... 10-2016-0180730

(51) Int. Cl.
*A63B 24/00* (2006.01)

(52) U.S. Cl.
CPC ..... *A63B 24/0006* (2013.01); *A63B 24/0062* (2013.01); *A63B 24/0075* (2013.01); *A63B 24/0087* (2013.01); *A63B 2024/0009* (2013.01); *A63B 2024/0081* (2013.01)

(58) Field of Classification Search
CPC ..... A63B 24/0006; A63B 24/0062; A63B 24/0087; A63B 24/0075
USPC ..... 455/41.2
See application file for complete search history.

(56) References Cited

U.S. PATENT DOCUMENTS

2007/0054778 A1* 3/2007 Blanarovich ..... A61B 5/103 482/8
2013/0267383 A1* 10/2013 Watterson ..... A63B 22/0235 482/4

FOREIGN PATENT DOCUMENTS

KR 10-1369777 3/2014
KR 10-1631789 6/2016

OTHER PUBLICATIONS

"IEEE Standard for Local and Metropolitan Area Networks—Part 15.6: Wireless Body Area Networks" in IEEE Std 802.15.6-2012, Feb. 29, 2012, 271 pages.

* cited by examiner

*Primary Examiner* — Ayodeji O Ayotunde
(74) *Attorney, Agent, or Firm* — Nixon & Vanderhye, P.C.

(57) ABSTRACT

An example apparatus and an example method for detecting user's exercise information in an exercise system are disclosed. An example electronic device includes: at least one sensor; a human body communication circuitry; a conductive member electrically connected with the human body communication circuitry and exposed for user contact; and at least one processor. The at least one processor is configured to detect a user's contact to the conductive member, to control the human body communication circuitry to transmit at least one piece of user information to an external device through a body of the user, and, when exercise information is received from the external device, to store the exercise information.

20 Claims, 22 Drawing Sheets

METHOD FOR DETECTING INFORMATION OF EXERCISE AND ELECTRONIC DEVICE THEREOF

CROSS-REFERENCE TO RELATED APPLICATION

The present application is based on and claims priority under 35 U.S.C. § 119 to an application filed in the Korean Intellectual Property Office on Dec. 28, 2016 and assigned Serial No. 10-2016-0180730, the contents of which are incorporated by reference herein in their entirety.

BACKGROUND

1. Technical Field

The present disclosure generally relates to an apparatus and a method for detecting a user's exercise information in an exercise system.

2. Description of Related Art

As people's interest in health increases, interest in exercise increases as a means for maintaining their health. As people's interest in exercise increases, various types of exercise equipment for satisfying users' demands for exercise are being developed. For example, exercise equipment such as a treadmill and a fitness bike may record various programs and users' exercise information in order to enhance users' exercise efficiency.

SUMMARY

The inputting of user authentication information to exercise equipment in order to obtain exercise information through the exercise equipment, or the operating of items on a user's electronic device one by one in order to transmit user authentication information to the exercise equipment may cause inconvenience.

In addition, when a user using the exercise equipment changes, but user authentication is not performed, there may be a problem that the exercise equipment does not properly obtain exercise information of the corresponding user.

The present disclosure provides an apparatus and a method for detecting a user's exercise information based on authentication information which is received through human body communication in exercise equipment.

The present disclosure also describes an apparatus and a method for transmitting authentication information to exercise equipment through human body communication in an electronic device.

According to an example embodiment of the present disclosure, exercise equipment includes: at least one sensor; human body communication circuitry; a conductive member (e.g., electrode) electrically connected with the human body communication circuitry and exposed to the outside (e.g., exposed for user contact); and at least one processor, wherein the at least one processor is configured to detect a user's contact through the conductive member, to receive at least one piece of user information of an external device through a body of the user using the human body communication circuitry, and, when authentication of the user succeeds based on the at least one piece of user information of the external device, to collect exercise information of the user through the at least one sensor.

According to another example embodiment of the present disclosure, an electronic device includes: human body communication circuitry; a conductive member (e.g., electrode) electrically connected with the human body communication module and exposed to the outside (e.g., exposed for user contact); and at least one processor, wherein the at least one processor is configured to detect a user's contact through the conductive member, to control the human body communication module to transmit at least one piece of user information to an external device through a body of the user, and, when exercise information is received from the external device, to store the exercise information.

According to another example embodiment of the present disclosure, an operation method of an electronic device includes: detecting a user's contact through a conductive member (e.g., electrode) exposed to the outside of the electronic device (e.g., exposed for user contact); transmitting at least one piece of user information to an external device through a body of the user which is in contact with the electronic device; receiving exercise information from the external device; and storing the exercise information.

BRIEF DESCRIPTION OF THE DRAWINGS

The above and other aspects, features and attendant advantage of the present disclosure will be more apparent and readily appreciated from the following detailed description, taken in conjunction with the accompanying drawings, in which like reference numerals refer to like elements and wherein.

DETAILED DESCRIPTION

Figure 1:
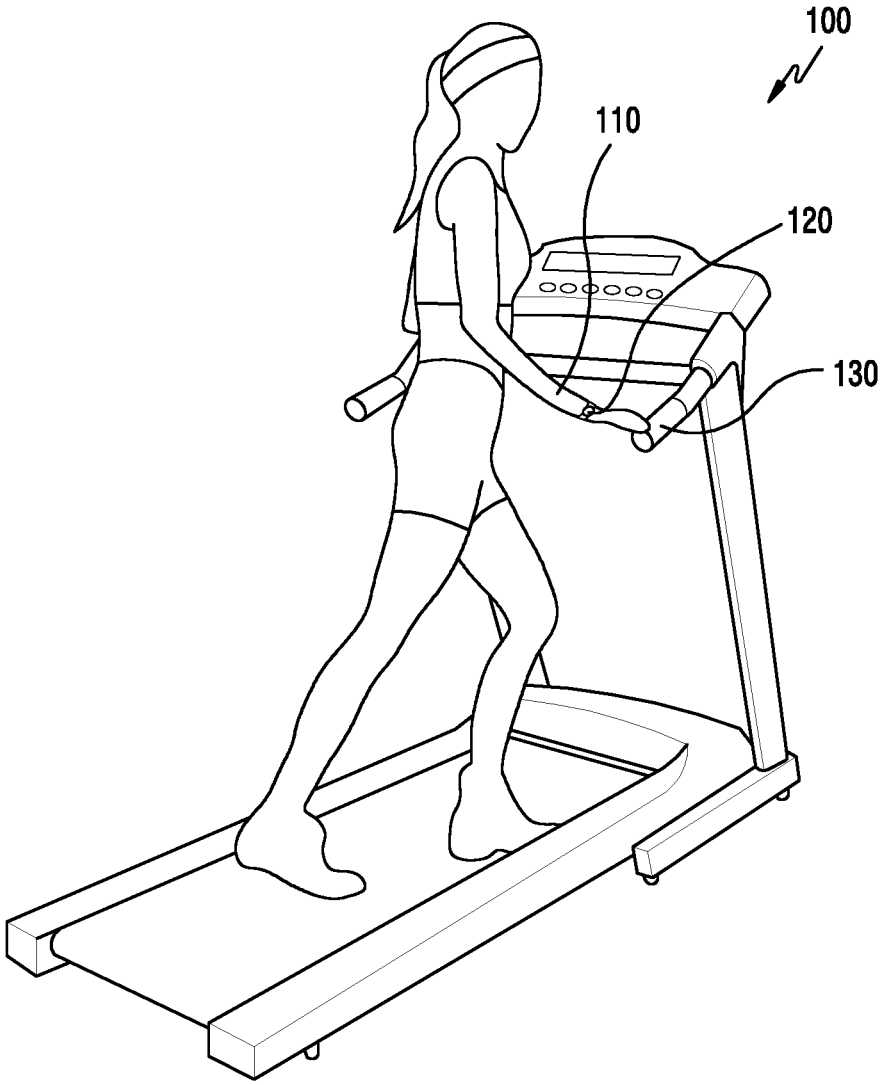
FIG. 1 is a view illustrating a configuration of a system for transmitting authentication information through human body communication according to various example embodiments of the present disclosure.

Hereinafter, various example embodiments of the present disclosure are described with reference to the accompanying drawings. It should be understood, however, that it is not intended to limit the various example embodiments of the present document to the particular form disclosed, but, on the contrary, it is intended to cover all modifications, equivalents, and alternatives falling within the spirit and scope of the various example embodiments of the present disclosure. Like reference numerals denote like components throughout the drawings. A singular expression includes a plural concept unless there is a contextually distinctive difference therebetween.

In the present document, an expression "A or B", "A and/or B", or the like may include all possible combinations of items enumerated together. Although expressions such as "$1^{st}$", "$2^{nd}$" "first", and "second" may be used to express corresponding constitutional elements, it is not intended to limit the corresponding constitutional elements. When a certain (e.g., $1^{st}$) constitutional element is mentioned as being "operatively or communicatively coupled with/to" or "connected to" a different (e.g., $2^{nd}$) constitutional element, the certain constitutional element is directly coupled with/to another constitutional element or can be coupled with/to the different constitutional element via another (e.g., $3^{rd}$) constitutional element.

An expression "configured to" used in the present disclosure may be interchangeably used with, for example, "suitable for", "having the capacity to", "adapted to", "made to", "capable of", or "designed to" in a hardware or software manner according to a situation. In a certain situation, an expressed "a device configured to" may imply that the device is "capable of" together with other devices or components. For example, "a processor configured to perform A, B, and C" may imply a dedicated processor (e.g., an embedded processor) for performing a corresponding operation or a generic-purpose processor (e.g., Central Processing Unit (CPU) or an application processor) capable of performing corresponding operations by executing one or more software programs stored in a memory device.

An electronic device according to various example embodiments of the present disclosure, for example, may include, without limitation, at least one of a portable key, a smartphone, a tablet personal computer (PC), a mobile phone, a video phone, a personal digital assistant (PDA), a portable multimedia player (PMP), an MP3 player, a mobile medical appliance, a camera, and a wearable device (e.g., smart glasses, a head-mounted-device (HMD), electronic clothes, an electronic bracelet, an electronic necklace, an electronic appcessory, an electronic tattoo, a smart mirror, and a smart watch).

Exercise equipment according to various example embodiments of the present disclosure, for example, may include, without limitation, at least one of a running machine, a rowing machine, pilates equipment, a stepper, a bench press, a high bar, a dumbbell, and a bicycle.

A management device according to various example embodiments of the present disclosure, for example, may include, without limitation, at least one of a smartphone, a tablet personal computer (PC), a mobile phone, a video phone, an electronic book (e-book) reader, a desktop PC, a laptop PC, a netbook computer, a workstation, a server, a personal digital assistant (PDA), a portable multimedia player (PMP), an MP3 player, a mobile medical appliance, a camera, and a wearable device.

According to some example embodiments, the management device (e.g., home appliance) may include, without limitation, at least one of, for example, a television, a Digital Video Disk (DVD) player, an audio, a refrigerator, an air conditioner, a vacuum cleaner, an oven, a microwave oven, a washing machine, an air cleaner, a set-top box, a home automation control panel, a security control panel, a TV box (e.g., Samsung HomeSync™, Apple TV™, or Google TV™), a game console (e.g., Xbox™ and PlayStation™), an electronic dictionary, an electronic key, a camcorder, and an electronic photo frame.

According to another example embodiment, the management device may include, without limitation, at least one of various medical devices (e.g., various portable medical measuring devices (a blood glucose monitoring device, a heart rate monitoring device, a blood pressure measuring device, a body temperature measuring device, and the like), a Magnetic Resonance Angiography (MRA), a Magnetic Resonance Imaging (MRI), a Computed Tomography (CT) machine, and an ultrasonic machine), a navigation device, a Global Positioning System (GPS) receiver, an Event Data Recorder (EDR), a Flight Data Recorder (FDR), Vehicle Infotainment Devices, an electronic devices for a ship (e.g., a navigation device for a ship, and a gyro-compass), avionics, security devices, an automotive head unit, a robot for home or industry, an automatic teller's machine (ATM) in banks, point of sales (POS) in a shop, or internet device of things (e.g., a light bulb, various sensors, electric or gas meter, a sprinkler device, a fire alarm, a thermostat, a streetlamp, a toaster, a sporting goods, a hot water tank, a heater, a boiler, etc.).

According to some example embodiments, the management device may include, without limitation, at least one of a part of furniture or a building/structure, an electronic board, an electronic signature receiving device, a projector, and various kinds of measuring instruments (e.g., a water meter, an electric meter, a gas meter, and a radio wave meter). The electronic device or management device according to various example embodiments of the present disclosure may be a combination of one or more of the aforementioned various devices. The electronic device or management device according to some example embodiments of the present disclosure may be a flexible device. Further, the electronic device or management device according to an example embodiment of the present disclosure is not limited to the aforementioned devices, and may include a new electronic device according to the development of technology.

Hereinafter, an electronic device or management device according to various example embodiments will be described with reference to the accompanying drawings. As used herein, the term "user" may indicate a person who uses an electronic device or a device (e.g., an artificial intelligence electronic device) that uses an electronic device.

FIG. 1 is a view illustrating a configuration of a system for transmitting authentication information through human body communication according to various example embodiments of the present disclosure.

Referring to FIG. 1, the system 100 for human body communication may include an electronic device 120 which contacts a body of a user 110, and exercise equipment 130.

According to one example embodiment, the electronic device 120 may transmit authentication information through the body of the user 110 when the electronic device 102 is contacted by the skin of the user 110. For example, when the electronic device 120 (e.g., a wearable electronic device) is contacted by the skin of the user 110, the electronic device 120 may determine whether a motion of the user 110 is detected. When the motion of the user 110 is detected through a motion sensor, the electronic device 120 may transmit authentication information of the corresponding user through the body of the user 110 which is in contact with the electronic device 120. For example, the electronic device 120 may periodically transmit user's authentication information. For example, the authentication information may include at least one piece of user information, and the user information may include at least one of a membership number, a portion of a resident registration number, a phone number, an identification (ID), vein (blood vessel) information, age, and a name, or information of a combination of at least one of the aforementioned pieces of information.

According to one embodiment, when contact (touch) of the user 110 is detected, the exercise equipment 130 may receive authentication information through the body of the user 110. The exercise equipment 130 may authenticate the user using the authentication information received through the body of the user 110. For example, when user authentication is successful, the exercise equipment 130 may collect exercise information of the corresponding user and may transmit the exercise information to the electronic device 120 or a management device (not shown). According to one example embodiment, when generation of an authentication event is detected based on contact information of the user 110, the exercise equipment 130 may transmit an authentication information request signal to the electronic device 120 through the body of the user 110. The exercise equipment 130 may receive authentication information through the body of the user 110 in response to the authentication information request signal.

Figure 2A:
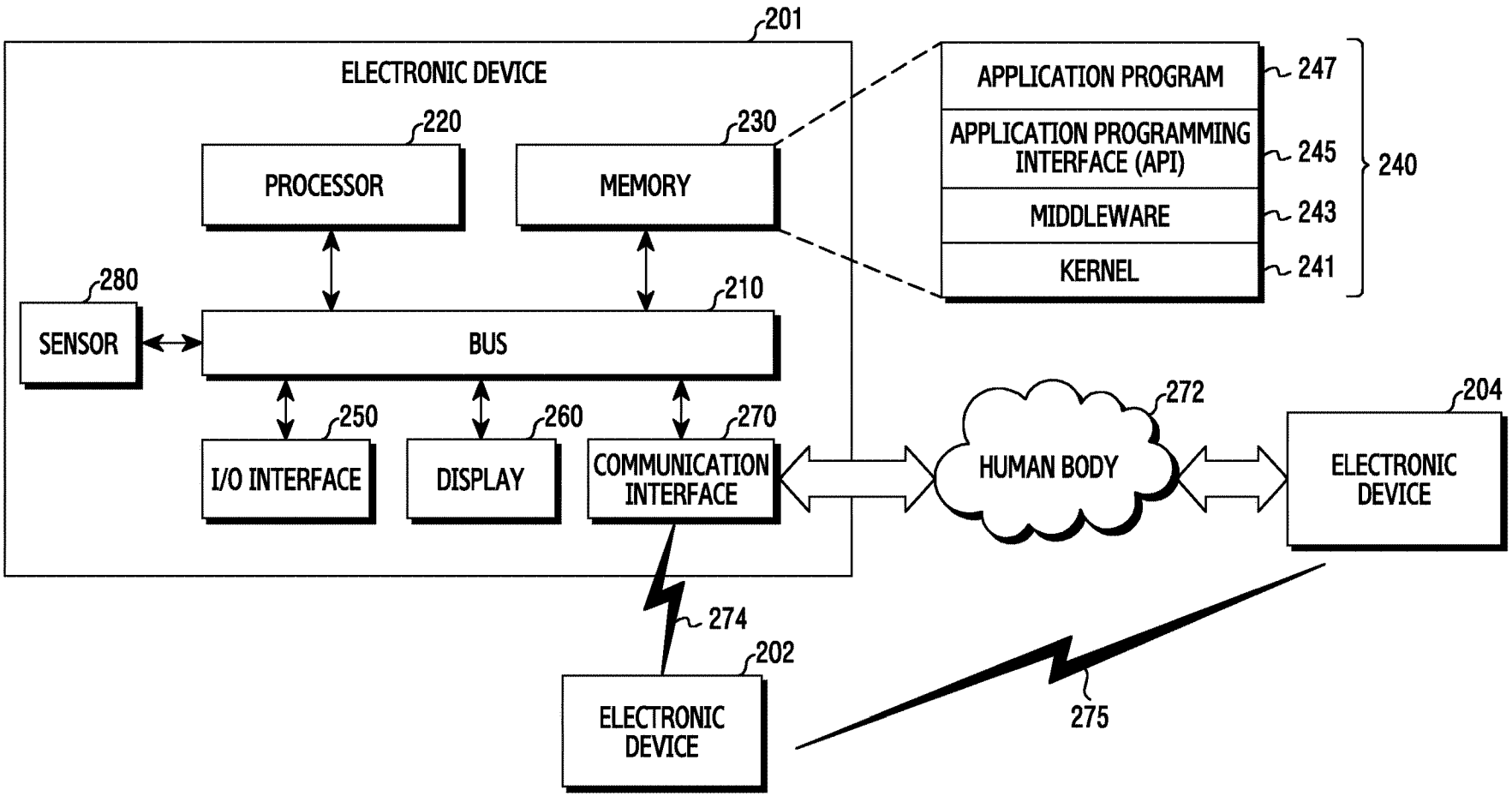
FIG. 2A is a view illustrating an electronic device according to various example embodiments of the present disclosure.

FIG. 2A is a view illustrating an electronic device 201 according to various example embodiments of the present disclosure. In the following description, the electronic device 201 may include the electronic device 120 of FIG. 1.

Referring to FIG. 2A, the electronic device 201 may include a bus 210, a processor 220, a memory 230, an input/output (I/O) interface 250, a display 260, a communication interface 270, and a sensor 280. According to certain example embodiments, the electronic device 201 may omit at least one of the above-described elements or may further include other element(s) (not shown).

The bus 210 may interconnect the above-described elements 220 to 280, and may include circuitry for conveying communications (for example, a control message and/or data) between and among the above-described elements.

The processor (e.g., processing circuitry) 220 may include one or more of a central processing unit (CPU), an application processor (AP), an image signal processor (ISP), or a communication processor (CP). The processor 120 may perform, for example, operations or data processing associated with control and/or communication of at least one other element(s) of the electronic device 201.

According to one embodiment, the processor 220 may control transmitting authentication information of the electronic device 201 to an external device (e.g., electronic device 204 such as exercise equipment) through a body 272 of a user (for example, the user 110 of FIG. 1) which is in contact with the electronic device 201 and with the external device. For example, when contact with a body of a user is detected through an electrode of the communication interface 270, the processor 220 may control the communication interface 270 to transmit user authentication information of the electronic device 201, which is stored in the memory 230, to the external device 204 through the body 272 of the user. According to one example embodiment, the processor 220 may control the communication interface 270 to periodically transmit the user's authentication information for a pre-defined time. For example, the user's authentication information may include at least one of user's identification information (for example, a phone number), application identification information, unique identification information (for example, membership information) allocated to the user in a specific place, and a certain value.

According to one example embodiment, the processor 220 may control transmitting the authentication information of the electronic device 201 to the external device 204 through the body 272 of the user based on motion information of the user who is in contact with the electronic device 201. For example, when the electronic device 201 detects contact with a body of a user, the processor 220 may determine whether a user's motion is made using sensor data received from the sensor 280. When the user's motion is detected, the processor 220 may control transmitting the user authentication information of the electronic device 201 to the external device 204 through the body 272 of the user. For example, the user's motion may include motion greater than or equal to a pre-determined amount of motion.

According to one example embodiment, the processor 220 may control transmitting the authentication information of the electronic device 201 to the external device through the body 272 of the user based on a request of electronic device 204 (e.g., exercise equipment). For example, when the electronic device 201 detects contact with a body of a user, the processor 220 may determine whether an authentication information request signal of the exercise equipment is received. When the authentication information request signal is received through the communication interface 270, the processor 220 may control transmitting the user authentication information of the electronic device 201 to the exercise equipment through the body 272 of the user.

According to one example embodiment, the processor 220 may control transmitting exercise information of a user to the exercise equipment. For example, when identification information of the exercise equipment by which the user is authenticated is acquired, the processor 220 may determine a recommended exercise program in the corresponding exercise equipment based on at least one of personal information and an exercise history of the user. The processor 220 may control transmitting the recommended exercise program information to the exercise equipment through the body 272 of the user. For example, the personal information may include, without limitation, at least one of age, sex, biometric information, and a disease history of the user. According to one example embodiment, the processor 220 may control the memory 230 to map the identification information of the exercise equipment and the recommended exercise program information and store the mapped information.

According to one example embodiment, the processor 220 may collect a user's biometric information. For example, when authentication success information for a user is received from the exercise equipment, the processor 220 may collect a user's biometric change information through at least one sensor which is in contact with the body 272 of the user. For example, the biometric change information may include, without limitation, at least one of a heartbeat, blood pressure, and oxygen saturation.

According to one example embodiment, the processor 220 may control output of a user's exercise information. For example, when the user's exercise information is received from the exercise equipment through the body 272 of the user or through wireless resources (e.g., via a management device such as electronic device 202 via wireless communication links 274 and 275), the processor 220 may control to display the user's exercise information through a display electrically connected with the electronic device 201. The processor 220 may alternatively or additional control output of the exercise information through sound(s). For example, the exercise information received from the exercise equipment may include, without limitation, at least one piece of information of an exercise time, number of times of exercising, a distance, and burned calories, as a portion of the exercise information detected by the exercise equipment.

The memory 230 may include a volatile memory and/or nonvolatile memory. The memory 230 may store, for example, instructions or data associated with at least one other element(s) of the electronic device 201. For example, the memory 230 may store a user's personal information and a user's exercise history. For example, the memory 230 may map identification information of exercise equipment which is contacted by a user and recommended exercise program information transmitted to the corresponding exercise equipment, and may store the mapped information. For example, the memory 230 may map identification information of exercise equipment which is contacted by a user and exercise information provided from the corresponding exercise equipment, and may store the mapped information. According to one example embodiment, the memory 230 may store software and/or a program(s) 240. The program(s) 240 may include, for example, a kernel 241, middleware 243, an application programming interface (API) 245, and/or an application program (or an "application") 247. At least a portion of the kernel 241, the middleware 243, and/or the API 245 may be called an operating system. The kernel 241 may control or manage system resources (for example, the bus 210, the processor 220, the memory 230, or the like) that are used to execute operations or functions of other programs (for example, the middleware 243, the API 245, and/or the application program 247). Furthermore, the kernel 241 may provide an interface that allows the middleware 243, the API 245, and/or the application program 247 to access discrete elements of the electronic device 201 so as to control or manage system resources.

The middleware 243 may perform a mediation role such that the API 245 or the application program 247 communicates with the kernel 241 to exchange data. Furthermore, the middleware 243 may process one or more task requests received from the application program 247 according to a priority. For example, the middleware 243 may assign the priority, which makes it possible to use a system resource (for example, the bus 210, the processor 220, the memory 230, or the like) of the electronic device 201, to at least the application program 247, and may process the one or more task requests. The API 245 may be an interface through which the application program 247 controls a function provided by the kernel 241 or the middleware 243, and may include, for example, at least one interface or function (for example, an instruction) for file control, window control, image processing, character control, or the like.

The input/output (I/O) interface (e.g., input/output interface circuitry) 250 may transmit an instruction or data, inputted from a user or another external device, to other element(s) of the electronic device 201, or may output an instruction or data, received from other element(s) of the electronic device 201, to the user or another external device.

The display 260 may include, for example, a liquid crystal display (LCD) (e.g., an IPS LCD), a light emitting diode (LED) display, an organic LED (OLED) display, a microelectromechanical systems (MEMS) display, or an electronic paper display. The display 260 may display, for example, various contents (for example, text, image(s), video, icon(s), and/or symbol(s)) to a user. The display 260 may include a touch screen and may receive, for example, a touch, a gesture, proximity, or hovering input using an electronic pen or a portion of a user's body. For example, the display 260 may display exercise information provided from exercise equipment or user's biometric change information detected by the processor 220.

The communication interface (e.g., communication interface circuitry) 270 may establish communication between the electronic device 201 and an external device (for example, the external electronic device 202, external electronic device 204 and/or other external devices such as a server). For example, the communication interface 270 may perform communication with an external device (for example, the external electronic device 204 such as exercise equipment) by the medium of a user's body through an electrode which is in contact with the user's body. For example, the communication interface 270 may communicate with an external device (for example, a second external electronic device 202 or a server) through wireless communication or wired communication. For example, with reference to FIG. 2A, electronic device 201 may communicate with electronic device 204 via an electronic device 202 (e.g., a management device) over wireless communication links 274 and 275. For example, certain exercise information at the end of an exercise session may be sent from electronic device 204 (exercise equipment) to management device 202. Management device 202 may store this exercise information and communicate some or all of this information to electronic device 201.

According to one example embodiment, the wireless communication may include, without limitation, cellular communication using at least one of, for example, long term evolution (LTE), LTE Advanced (LTE-A), code division multiple access (CDMA), wideband CDMA (WCDMA), universal mobile telecommunications system (UMTS), wireless broadband (WiBro), global system for mobile communications (GSM), or the like.

According to one example embodiment, the wireless communication may include, for example, at least one of wireless fidelity (WiFi), Bluetooth, Bluetooth low energy (BLE), Zigbee, near field communication (NFC), magnetic secure transmission, radio frequency (RF), or a body area network (BAN). According to one example embodiment, the wireless communication may include, without limitation, global navigation satellite system (GNSS). The GNSS may include, for example, global positioning system (GPS), global navigation satellite system (Glonass), BeiDou navigation satellite system (hereinafter, referred to as "BeiDou") or Galileo (the European global satellite-based navigation system). Hereinafter, "GPS" and "GNSS" may be interchangeably used in the present disclosure. The wired communication may include, without limitation, at least one of, for example, a universal serial bus (USB), a high-definition multimedia interface (HDMI), a recommended standard-232 (RS-232), power line communication, or a plain old telephone service (POTS).

Each of the first and second external electronic devices 202 and 204 may be the same or different type of device as or from the electronic device 201. In one non-limiting example embodiment, electronic device 201 is a wearable electronic device (e.g., an electronic watch), electronic device 204 is exercise equipment such as a treadmill, elliptical machine, stationary bicycle, weight machine, free weights, and the like, and electronic device 202 is a management device such as a smart phone. According to various example embodiments, all or a part of operations that the electronic device 201 will perform may be executed by another or plural other electronic devices (for example, the electronic devices 202 and 204 and/or a server). According to one example embodiment, in a case in which the electronic device 201 executes any function or service automatically or in response to a request, the electronic device 201 may not perform the function or the service internally, but, alternatively or additionally, it may request at least a portion of a function associated with the electronic device 201 at another device (for example, the electronic device 202 or 204 and/or a server (not shown)). The other electronic device (for example, the electronic device 202 or 204 or a server) may execute the requested function or additional function and may transmit the execution result to the electronic device 201. The electronic device 201 may provide the requested function or service using the received result or may additionally process the received result to provide the requested function or service. To achieve this, for example, cloud computing, distributed computing, or client-server computing may be used.

The sensor 280 may include at least one sensor and associated circuitry for measuring a physical quantity corresponding to, for example and without limitation, the electronic device 201 or detecting a motion state of the electronic device 201, or for detecting a user's biometric information. The sensor 280 may further include a control circuit for controlling the at least one sensor.

Figure 2B:
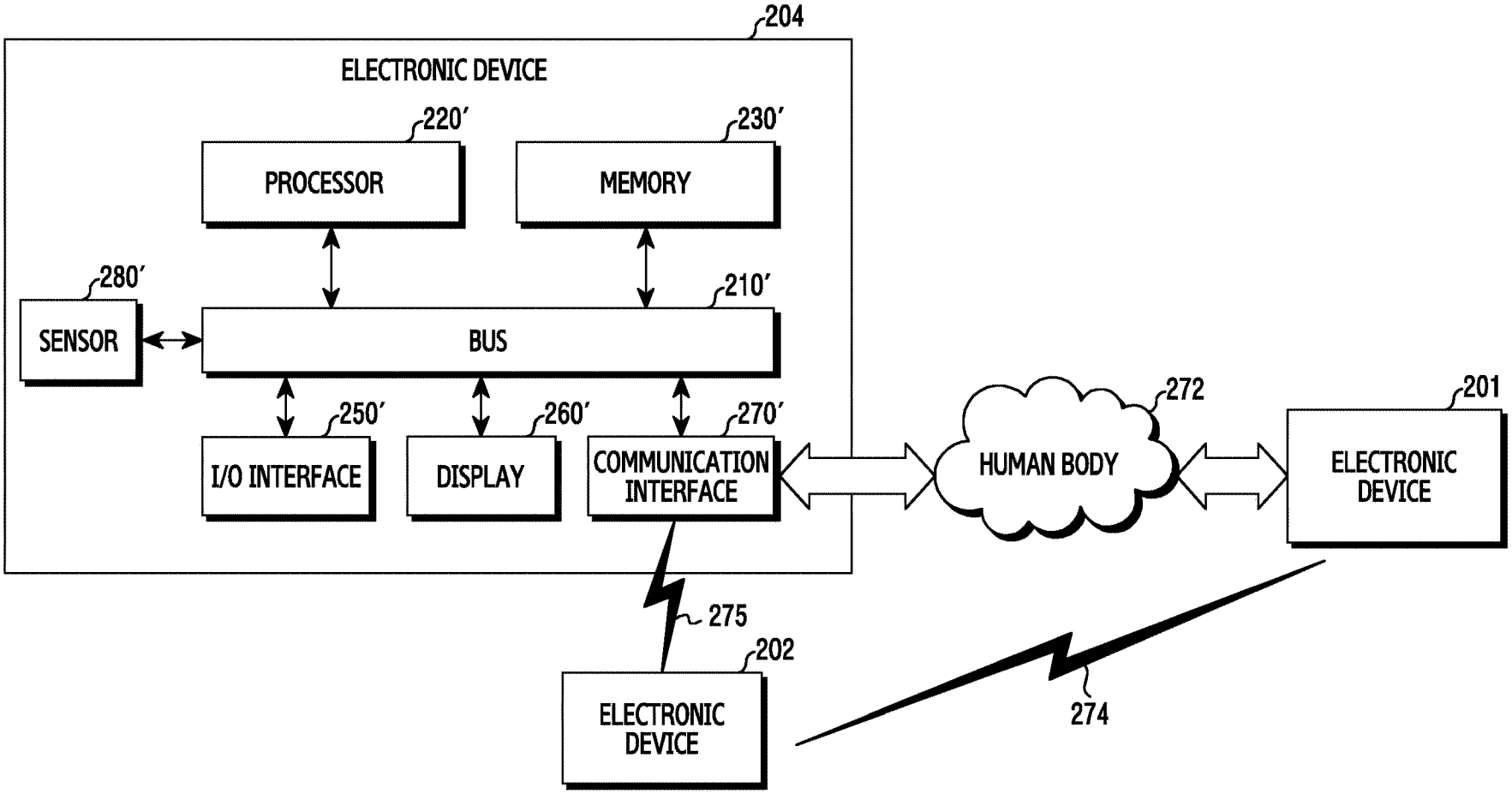
FIG. 2B is a view illustrating another electronic device according to various example embodiments of the present disclosure.

According to various example embodiments, as shown in FIG. 2B, exercise equipment may include a bus 210', a processor 220', a memory 230', an input/output interface 250', a display 260', a communication interface 270', and a sensor 280' arranged in a similar configuration to the components of the electronic device 201 of FIG. 2A. In a certain example embodiments, the exercise equipment may omit at least one of the elements or may further include other element(s).

According to one example embodiment, the processor 220' of the exercise equipment may receive a user's authentication information through the body 272 of a user (for example, the user 110 of FIG. 1) which is in contact with the exercise equipment. For example, when user's body contact with the exercise equipment is detected through an electrode electrically connected with the communication interface 270' of the exercise equipment, the processor 220' of the exercise equipment may activate at least a portion (for example, a human body communication module including communication circuitry) of the communication interface 270' of the exercise equipment for human body communication. The processor 220' of the exercise equipment may receive a user's authentication number (and/or other information) through the activated human body communication module.

According to one example embodiment, the processor 220' of the exercise equipment may control transmitting identification information of the exercise equipment to an external device (for example, the electronic device 201) through the body 272 of the user (for example, the user 110 of FIG. 1) which is in contact with the exercise equipment. For example, when authentication succeeds using the user's authentication information provided from the external device 201, the processor 220' of the exercise equipment may transmit identification information (for example, an ID) of the exercise equipment to the external device 201 through the body 272 of the user that is in contact with the exercise equipment. For example, the processor 220' of the exercise equipment may determine whether an identification information transmission event is generated based on user's body contact information. When the identification information transmission event is generated, the processor 220' of the exercise equipment may transmit the identification information (for example, the ID) of the exercise equipment to the external device 201 through the body 272 of the user which is in contact with the exercise equipment. According to one example embodiment, when authentication of the user succeeds using the user's authentication information, the processor 220' of the exercise equipment may determine whether the identification information transmission event is generated. For example, the processor 220' of the exercise equipment may determine whether the identification information transmission event is generated based on at least one of the number of times the user contacts the exercise equipment and a contact holding time.

According to one example embodiment, when the user of the external device is authenticated, the processor 220' of the exercise equipment may detect exercise information corresponding to the corresponding user. For example, the processor 220' of the exercise equipment may receive recommended exercise program information of the corresponding user through the body 272 of the user that is in contact with the exercise equipment. For example, as described above, the processor 220 of electronic device 201 may determine a recommended exercise program of the corresponding user based on an exercise history of the corresponding user which is stored in the memory 230. According to another embodiment, the processor 220' may determine recommended exercise program information corresponding to the user of the external device 204 through a management device (for example, the electronic device 202) or may generate the recommended exerciser program information itself. For example, the recommended exercise program information may include at least one of a course of an exercise to be performed through the exercise equipment, the number of times of exercising, a weight, and an exercise time.

According to one example embodiment, the processor 220' of the exercise equipment may detect a user's exercise information using a sensor of the exercise equipment. For example, when the authentication of a user who is in contact with the exercise equipment succeeds, the processor 220' of the exercise equipment may recognize that the corresponding user starts exercising, and may collect a user's exercise information. For example, the processor 220' of the exercise equipment may determine whether an exercise start event is generated based on body contact information of the user who is authenticated using the authentication information provided through the body 272 of the user. When the exercise start event is generated, the processor 220' of the exercise equipment may recognize that the corresponding user starts exercising and may collect the user's exercise information. For example, the processor 220' of the exercise equipment may determine whether the exercise start event is generated based on at least one of the number of times the user contacts the exercise equipment and a contact holding time. For example, when the user is authenticated using the authentication information provided through the body 272 of the user, the processor 220' of the exercise equipment may determine whether an input to an exercise button is detected. When the input to the exercise button is detected, the processor 220' of the exercise equipment may recognize that the user starts exercising and may collect the user's exercise information.

According to one example embodiment, the processor 220' of the exercise equipment may continuously detect user's exercise information until an exercise end time of the user on the exercise equipment. For example, when the user's contact with the exercise equipment is maintained, the processor 220' of the exercise equipment may recognize that the user is exercising and may continuously collect a user's exercise information. That is, when the user's contact with the exercise equipment is released, the processor 220' of the exercise equipment may determine that the user's exercise is finished. For example, when user's contact is detected again before a reference time elapses from the time that the user's contact with the exercise equipment is released, the processor 220' of the exercise equipment may recognize that the user is exercising and may continuously collect a user's exercise information. That is, when user's contact with the exercise equipment is not detected even after the reference time elapses, the processor 220' of the exercise equipment may determine that the user's exercise is finished. For example, when user's exercise information is collected through authentication of the user who is in contact with the exercise equipment, the processor 220' of the exercise equipment may determine whether an input to an exercise button to finish or stop exercising is detected. When the input to the exercise button is detected, the processor 220' of the exercise equipment may recognize that the exercise of the corresponding user is finished or stopped, and may finish or stop collecting the user's exercise information.

According to one example embodiment, the processor 220' of the exercise equipment may control transmitting the user's exercise information to at least one external device. For example, when the user's exercise information is collected, the processor 220' of the exercise equipment may determine whether the user's contact with the exercise equipment is maintained or not. When user's contact with the exercise equipment is detected, the processor 220' of the exercise equipment may periodically transmit the user's exercise information to an external device (e.g., electronic device 201) through the body 272 of the user. In this case, the processor 220' of the exercise equipment may control to extract only a portion of the user's exercise information collected through the sensor of the exercise equipment and transmit the extracted information to the external device. For example, the processor 220' of the exercise equipment may extract, without limitation, at least one piece of information from among an exercise time, the number of times of exercising, a distance, and burned calories in the user's exercise information collected through the sensor of the exercise equipment, and may control transmitting the extracted information to the external device (for example, the electronic device 201) through the body 272 of the user. For example, when the user's exercise is finished, the processor 220' of the exercise equipment may determine whether the user's contact with the exercise equipment is maintained. When the user's contact with the exercise equipment is detected, the processor 220' of the exercise equipment may control transmitting at least a portion of the user's exercise information to the external device through the body 272 of the user. For example, when the user's exercise is finished, the processor of the exercise equipment may control transmitting the user's exercise information to a management device 202. For example, the processor 220' of the exercise equipment may transmit the user's exercise information to the management device through wireless communication of the communication interface 270' of the exercise equipment.

According to one example embodiment, the memory 230' of the exercise equipment may store reference information for user authentication and user's exercise history information.

Figure 3:
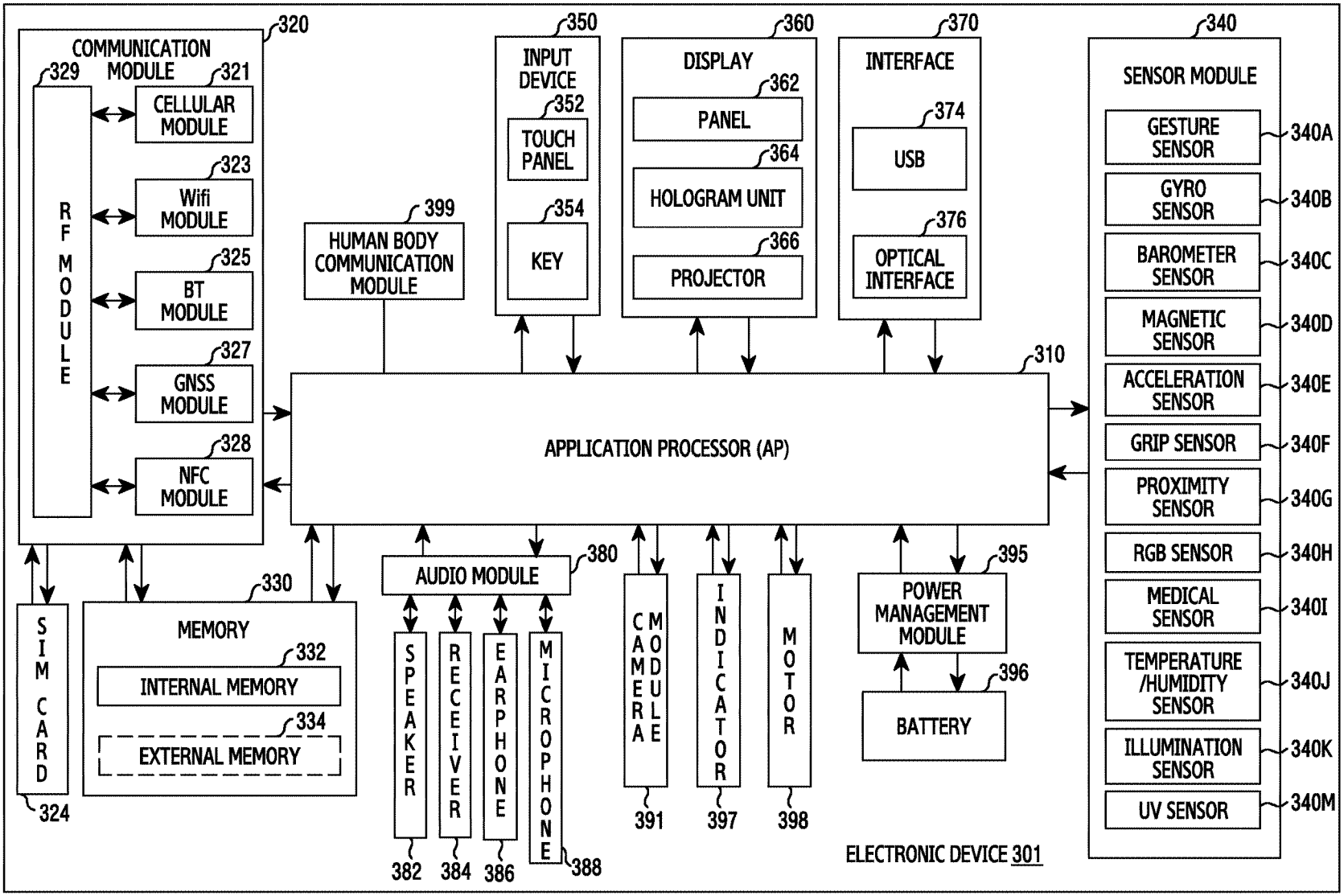
FIG. 3 is a block diagram of an electronic device according to various example embodiments of the present disclosure.

FIG. 3 is a block diagram of an electronic device 301 according to various example embodiments. The electronic device 301 may include, for example, an entirety or a part of the electronic device 201 illustrated in FIG. 2.

Referring to FIG. 3, the electronic device 301 may include one or more processors (for example, an AP) 310, a communication module (e.g., communication circuitry) 320, a subscriber identification module 324, a memory 330, a sensor module 340, an input device 350, a display 360, an interface 370, an audio module 380, a camera module 391, a power management module 395, a battery 396, an indicator 397, a motor 398, and a human body communication module 399.

For example, the processor (e.g., processing circuitry) 310 may drive an operating system or an application program to control a plurality of hardware or software elements connected to the processor 310, and may process and compute a variety of data. The processor 310 may be implemented by using a System on Chip (SoC), for example. According to one embodiment, the processor 310 may further include a graphic processing unit (GPU) and/or an image signal processor (ISP). The processor 310 may include at least a portion (for example, a cellular module 321) of other elements illustrated in FIG. 3. The processor 310 may load and process an instruction or data, which is received from at least one of the other elements (for example, a nonvolatile memory), in a volatile memory, and may store resulting data in a nonvolatile memory.

The communication module (e.g., communication circuitry) 320 may be configured the same as or similar to the communication interface 270 of FIG. 2. The communication module 320 may include, for example, a cellular module 321, a Wi-Fi module 323, a Bluetooth (BT) module 325, a GNSS module 327, a near-field communication (NFC) module 328, and an RF module 329. For example, the GNSS module may be GPS, a Glonass, Beidou (BeiDou navigation satellite system), or Galileo (the European global satellite-based navigation system).

The cellular module 321 may include circuitry for providing voice communication, video communication, a messaging service, an Internet service or the like through a communication network. According to one example embodiment, the cellular module 321 may perform discrimination and authentication of the electronic device 301 within a communication network using the subscriber identification module 324 (for example, a SIM card). According to one example embodiment, the cellular module 321 may perform at least a portion of functions provided by the processor 310. According to one example embodiment, the cellular module 321 may include a communication processor (CP).

According to a certain example embodiment, at least a portion (for example, two or more) of the cellular module 321, the Wi-Fi module 323, the Bluetooth module 325, the GNSS module 327, or the NFC module 328 may be included within one Integrated Circuit (IC) or an IC package.

The RF module 329 may include circuitry for transmitting and receiving a communication signal (for example, an RF signal), for example. The RF module 329 may include a transceiver, a power amplifier module (PAM), a frequency filter, a low noise amplifier (LNA), an antenna, and the like. According to another example embodiment, at least one of the cellular module 321, the Wi-Fi module 323, the Bluetooth module 325, the GNSS module 327, or the NFC module 328 may transmit and receive an RF signal through a separate RF module. The subscriber identification module 324 may include, for example, a card or an embedded SIM including a subscriber identification module, and may include unique identification information (for example, an integrated circuit card identifier (ICCID)) or subscriber information (for example, international mobile subscriber identity (IMSI)).

The memory 330 (for example, the memory 230 of FIG. 2) may include an internal memory 332 and/or an external memory 334. For example, the internal memory 332 may include, without limitation, at least one of a volatile memory (for example, a dynamic random access memory (DRAM), a static RAM (SRAM), or a synchronous DRAM (SDRAM)), and a nonvolatile memory (for example, a one-time programmable read only memory (OTPROM), a programmable ROM (PROM), an erasable and programmable ROM (EPROM), an electrically erasable and programmable ROM (EEPROM), a mask ROM, a flash ROM, a flash memory, a hard drive, and a solid state drive (SSD)). The external memory 334 may include, without limitation, a flash drive, for example, compact flash (CF), secure digital (SD), micro secure digital (Micro-SD), mini secure digital (Mini-SD), extreme digital (xD), multimedia card (MMC), a memory stick, or the like. The external memory 334 may be functionally or physically connected to the electronic device 301 through various interfaces.

The sensor module 340 (for example, the sensor 280 of FIG. 2) may include sensors and associated circuitry for measuring, for example, a physical quantity or detecting an operation state of the electronic device 301, and converting the measured or detected information into an electric signal. The sensor module 340 may include, without limitation, at least one of a gesture sensor 340A, a gyro sensor 340B, a barometer sensor 340C, a magnetic sensor 340D, an acceleration sensor 340E, a grip sensor 340F, a proximity sensor 340G, a color sensor 340H (for example, red, green, blue (RGB) sensor), a medical sensor 340I, a temperature/humidity sensor 340J, an illumination sensor 340K, and an UV sensor 340M. According to one embodiment, the sensor module 340 may include, for example, an E-nose sensor, an electromyography sensor (EMG) sensor, an electroencephalogram (EEG) sensor, an electrocardiogram (ECG) sensor, an infrared (IR) sensor, an iris sensor, and/or a fingerprint sensor. The sensor module 340 may further include control circuitry for controlling at least one sensor included therein. According to a certain example embodiment, the electronic device 301 may further include a processor (e.g., processing circuitry) which is a part of the processor 310 or a separate element from the processor 310 and is configured to control the sensor module 340. The processor 310 may control the sensor module 340 while the processor 310 remains in a sleep state. For example, the temperature/humidity sensor 340J may include a plurality of temperature sensors arranged at different locations.

The input device 350 may include, for example, inputs and associated circuitry such as a touch panel 352 or a key 354. The touch panel 352 may use at least one of capacitive, resistive, infrared or ultrasonic detecting methods. Also, the touch panel 352 may further include a control circuit. The touch panel 352 may further include a tactile layer to provide a tactile reaction (response) to a user. The key 354 may include, for example, a physical button, an optical key, a keypad, and the like.

The display 360 (for example, the display 260 of FIG. 2) may include a panel 362, a hologram device 364, a projector 366, and/or control circuitry for controlling the aforementioned elements. The panel 362 may be implemented to be flexible, transparent, or wearable. The panel 362 and the touch panel 352 may be integrated into one or more modules. The hologram device 364 may display a stereoscopic image in a space using a light interference phenomenon. The projector 366 may project light onto a screen so as to display an image. The screen may be arranged inside or outside the electronic device 301. The interface 370 may include, for example, a universal serial bus (USB) 374 or an optical interface 376 and associated circuitry. The interface 370 may be included, for example, in the communication interface 270 illustrated in FIG. 2. According to one example embodiment, the interface 370 may include, for example and without limitation, a mobile high definition link (MHL) interface, a SD card/multi-media card (MMC) interface, and an infrared data association (IrDA) standard interface.

The audio module 380 may include circuitry for converting sound and an electric signal in dual directions (bidirectional). The audio module 380 may process, for example, sound information that is inputted or outputted through a speaker 382, a receiver 384, an earphone 386, and/or a microphone 388.

The camera module 391 may be, for example, a device and associated circuitry for shooting a still image or a moving image, and according to one example embodiment, the camera module 391 may include, for example and without limitation, at least one image sensor (for example, a front sensor or a rear sensor), a lens, an image signal processor (ISP), and a flash (for example, an LED or a xenon lamp).

The power management module 395 may include circuitry for managing, for example, power of the electronic device 301. The power management module 395 may include a power management integrated circuit (PMIC), a charger IC, or a battery or fuel gauge. The PMIC may have a wired charging method and/or a wireless charging method. The wireless charging method may include, for example, a magnetic resonance method, a magnetic induction method or an electromagnetic wave method. The PMIC may further include an additional circuit for wirelessly charging, for example, a coil loop, a resonance circuit, or a rectifier, and the like. The battery gauge may measure, for example, a remaining capacity of the battery 396 and a voltage, current or temperature thereof while the battery is charged. The battery 396 may include, for example, a rechargeable battery and/or a solar battery.

The indicator 397 may display a specific state of the electronic device 301 or a portion thereof (for example, the processor 310), such as a booting state, a message state, a charging state, or the like. The motor 398 may convert an electrical signal into a mechanical vibration and may generate vibration, a haptic effect, and the like.

A human body communication module 399 may perform communication with an external device by the medium of a user's body through an electrode, which is in contact with the user's body, of the electronic device 301. For example, the human body communication module 399 may transmit user's authentication information to an external device (for example, exercise equipment) by the medium of the user's body. The human body communication module 399 may receive exercise information from the external device (for example, exercise equipment) by the medium of the user's body.

Each of the elements described in the present disclosure may be configured with one or more components, and the names of the elements may be changed according to the type of the electronic device. According to various example embodiments, some elements of the electronic device (for example, the electronic device 301) may be omitted or other additional elements may be added. Furthermore, some of the elements may be combined with each other so as to form one entity, and the functions of the elements may be performed in the same manner as before being combined.

Figure 4:
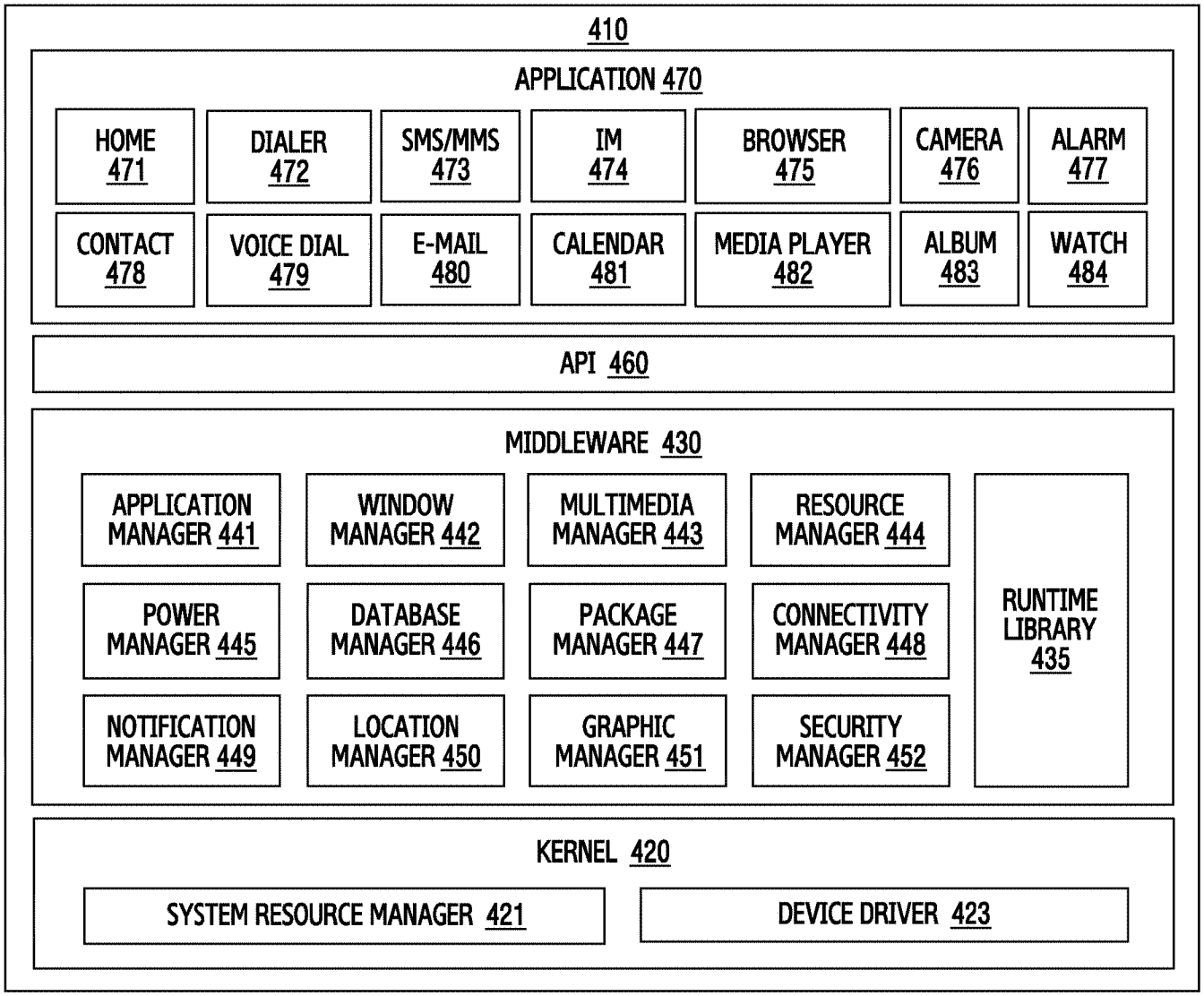
FIG. 4 is a block diagram of a program module according to various example embodiments of the present disclosure.

FIG. 4 is a block diagram of a program module according to various embodiments. According to one embodiment, a program module 410 (for example, the program 240 of FIG. 2) may include an operating system for controlling resources associated with an electronic device (for example, the electronic device 201) and/or various applications (for example, the application program 247) driven on the operating system. For example, the operating system may include, for example, Android™, iOS™, Windows™, Symbian™, Tizen™, Bada™, or the like. Referring to FIG. 4, the program module 410 may include a kernel 420 (for example, the kernel 241), middleware 430 (for example, the middleware 243), an API 460 (for example, the API 245), and/or an application 470 (for example, the application program 247). At least a portion of the program module 410 may be preloaded on the electronic device or downloaded from an external electronic device (for example, the electronic device 202, 204, a server, or the like).

The kernel 420 may include, for example, a system resource manager 421 and/or a device driver 423. The system resource manager 421 may control, allocate or collect the system resources. According to one example embodiment, the system resource manager 421 may include, without limitation, a process manager, a memory manager, or a file system manager. The device driver 423 may include, for example and without limitation, a display driver, a camera driver, a Bluetooth driver, a shared memory driver, a USB driver, a keypad driver, a WiFi driver, an audio driver, or an Inter-Process Communication (IPC) driver. The middleware 430 may provide functions which are commonly required by the application 470 or may provide various functions to the application 470 through the API 460 such that the application 470 can use limited system resources in the electronic device. According to one example embodiment, the middleware 430 may include, without limitation, at least one of a runtime library 435, an application manager 441, a window manager 442, a multimedia manager 443, a resource manager 444, a power manager 445, a database manager 446, a package manager 447, a connectivity manager 448, a notification manager 449, a location manager 450, a graphic manager 451, and a security manager 452.

For example, the runtime library 435 may include a library module which is used by a compiler to add a new function through a programming language while the application 470 is executed. The runtime library 435 may perform input/output management, memory management, an arithmetic function, and the like. The application manager 441 may manage a life cycle of the application 470, for example. The window manager 442 may manage GUI resources used in a screen. The multimedia manager 443 may determine a format necessary for reproducing media files and may encode and/or decode the media files by using a codec suited to the corresponding format. The resource manager 444 may manage a source code of the application 470 or a space of a memory. The power manager 445 may manage a capacity of a battery or a power source, for example, and may provide power information necessary for the operation of the electronic device. According to one example embodiment, the power manager 445 operates along with a basic input/output system (BIOS). The database manager 446 may generate, search, or change a database which is used in the application 470. The package manager 447 may manage installing or updating an application which is distributed in the form of a package file.

The connectivity manager 448 may manage a wireless connection, for example. The notification manager 449 may notify the user of an event such as a message arrived, an appointment, a notification of proximity, or the like. The location manager 450 may manage location information of the electronic device. The graphic manager 451 may manage, for example, a graphic effect to be provided to the user or a relevant user interface. The security manager 452 may provide, for example, system security or user authentication. According to one example embodiment, the middleware 430 may include a telephony manager to manage a speech or video telephony function of the electronic device, or a middleware module to form a combination of the various functions of the above-described elements. According to one example embodiment, the middleware 430 may provide a module which is customized according to a kind of an OS. The middleware 430 may dynamically delete a portion of the existing elements or may add new elements.

The API 460 may be, for example, a set of API programming functions and may be provided as a different configuration according to an OS. For example, in the case of Android or iOS, a single API set may be provided for each platform. In the case of Tizen, two or more API sets may be provided for each platform.

The application 470 may include, for example and without limitation, a home 471, a dialer 472, a Short Message Service (SMS)/Multimedia Messaging Service (MMS) 473, an Instant Message (IM) 474, a browser 475, a camera 476, an alarm 477, contacts 478, a voice dial 479, an email 480, a calendar 481, a media player 482, an album 483, a watch 484, an application for providing health care (for example, measuring exercise or a blood sugar) (not shown), or environmental information (for example, information on atmospheric pressure, humidity, or temperature) (not shown). According to one example embodiment, the application 470 may include an information exchanging application for supporting information exchange between the electronic device and an external electronic device. The information exchanging application may include, for example, a notification relay application for relaying specific information to an external electronic device or a device management application for managing an external electronic device. For example, the notification relay application may relay notification information generated in another application of the electronic device to an external electronic device, or may receive notification information from an external electronic device and provide the notification information to the user. The device management application may install, delete, or update, for example, a function (for example, turn-on/turn-off of an external electronic device itself (or a part of components) or adjustment of brightness (or resolution) of a display) of the external electronic device which communicates with the electronic device, or an application running in the external electronic device. According to one example embodiment, the application 470 may include an application (for example, a health care application of a mobile medical device) which is assigned in accordance with an attribute of the external electronic device. According to one example embodiment, the application 470 may include an application which is received from an external electronic device. At least a portion of the program module 410 may be implemented (for example, executed) by software, firmware, hardware (for example, the processor 310 of FIG. 3), or a combination of two or more thereof, and may include modules, programs, routines, sets of instructions, or processes, or the like for performing one or more functions.

FIGS. 5A, 5B, 5C, 5D and 5E are views illustrating exercise equipment according to various example embodiments of the present disclosure.

Figure 5A:
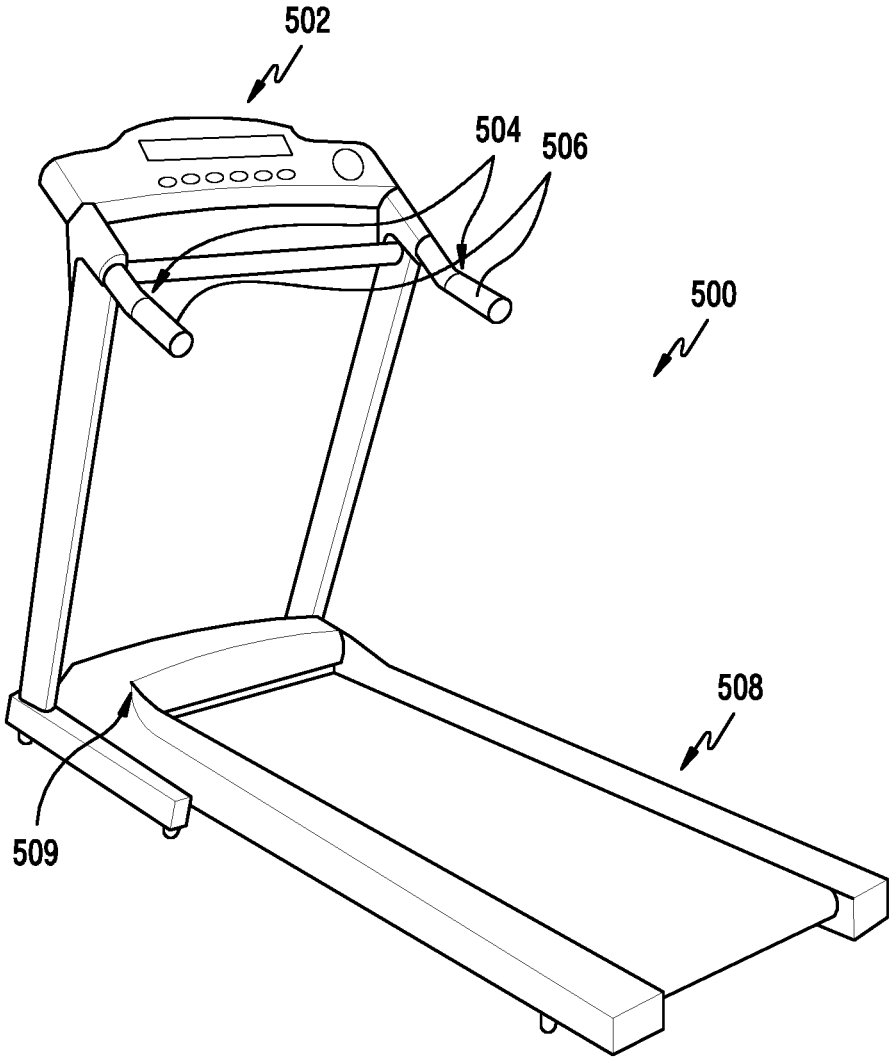
FIGS. 5A, 5B, 5C, 5D and 5E are views illustrating exercise equipment according to various example embodiments of the present disclosure.

According to one example embodiment, a treadmill 500 may include an upper frame 502 for user's operation and a lower frame 508 provided with a rotatable running conveyer belt as shown in FIG. 5A. For example, the upper frame 502 may include a display (for example, the display 260' of FIG. 2B) which is able to display driving information of the treadmill 500 and information about a user who is exercising, and at least one button (for example, the input/output interface 250' of FIG. 2B) for controlling the treadmill 500. The upper frame 502 may include two handles 504 which can be gripped by a user. For example, at least a portion 506 of each handle 504 that can be gripped by a user may be formed of a conductive component (conductive member) such as metal so as to enable human body communication. For example, the lower frame 508 may include the running conveyer belt (tread) which moves for a user's exercise, and a footboard for allowing the user to tread on the running conveyer belt or to step down therefrom. The lower frame 508 may include a driving motor 509 for driving the running conveyer belt. For example, the driving motor 509 may further include at least one sensor (for example, the sensor 280' of FIG. 2B) electrically connected with the driving motor to detect a rotation speed and an amount of rotation of the driving motor. For example, the treadmill 500 may detect exercise data using sensor data which is acquired through the at least one sensor electrically connected with the driving motor 509. The treadmill 500 may transmit the exercise data to an external device (for example, the electronic device 201 of FIG. 2A) by the medium of a body of a user which is in contact with the handle 504.

Figure 5B:
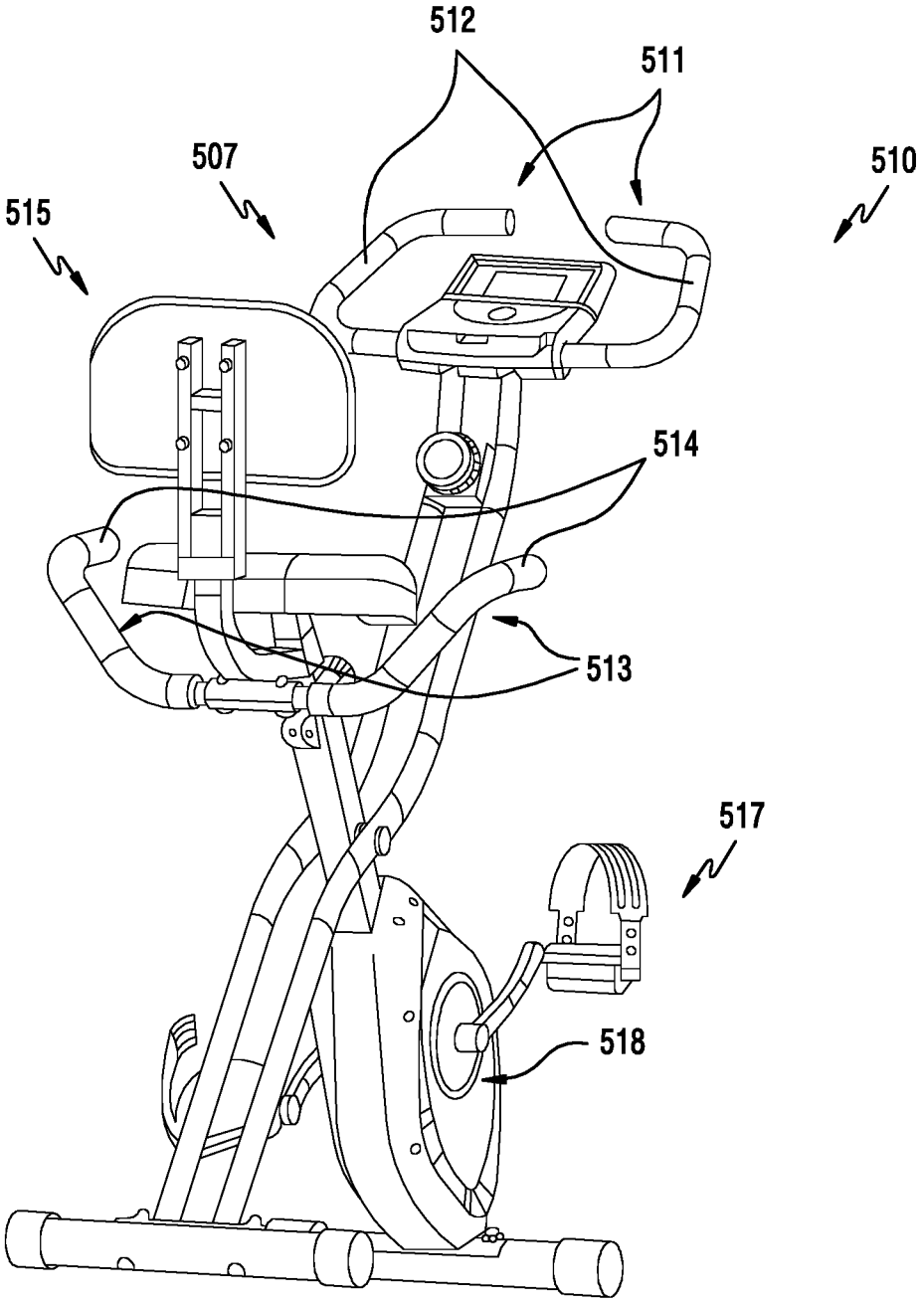

According to one example embodiment, as shown in FIG. 5B, a bike 510 may include an upper frame 507 for user's operation, handles 511, 513, a saddle 515 on which a user sits, and a main body 517 including pedals. For example, the upper frame 507 may include a display (for example, the display 260' of FIG. 2B) which is able to display driving information of the bike 510 and information of a user who is exercising, and at least one button (for example, the input/output interface 250' of FIG. 2B) for controlling the bike 510. The upper frame 507 may include two first handles 511 which can be gripped by a user. For example, at least a portion 512 of each first handle 511 that can be gripped by a user may be formed of a conductive component such as metal so as to enable human body communication. For example, the saddle 515 may include two second handles 513 which can be gripped by a user. For example, at least a portion 514 of each second handle 513 that can be gripped by a user may be formed of a conductive component such as metal so as to enable human body communication. For example, the main body 517 may include the pedals for allowing the user to pedal the bike 510 and a rotary plate 518 rotated by the pedals. The rotary plate 518 may further include a load rotation unit which is rotatable by the pedals, and at least one sensor (for example, the sensor 280' of FIG. 2B) which is electrically connected with the load rotation unit to detect a rotation speed and an amount of rotation of the load rotation unit. For example, the bike 510 may detect exercise data using sensor data which is acquired through the at least one sensor electrically connected with the load rotation unit. The bike 510 may transmit the exercise data to an external device (for example, the electronic device 201 of FIG. 2A) by the medium of a body of a user who is in contact with the handles 511, 513.

Figure 5C:
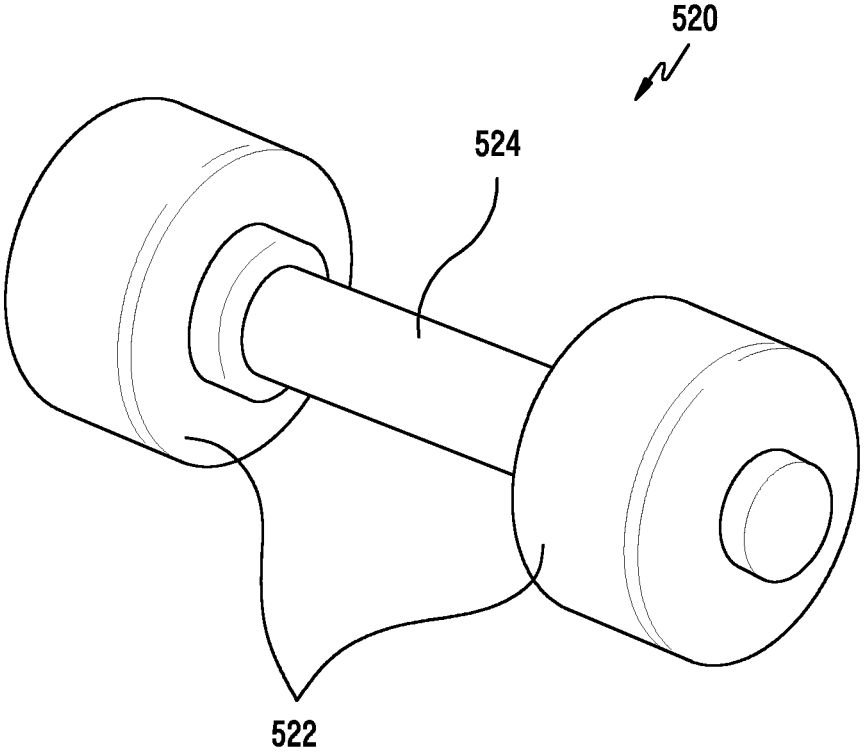

According to one example embodiment, as shown in FIG. 5C, a dumbbell 520 may include weights 522 formed of at least one circular plate and a handle 524 connecting the weights 522. For example, at least a portion of the handle 524 that can be gripped by a user may be formed of a conductive component such as metal so as to enable human body communication. According to one example embodiment, the dumbbell 520 may further include at least one sensor (for example, the sensor 280' of FIG. 2B) arranged in at least one of the weights 522 and the handle 524 to detect a motion of the dumbbell 520. For example, the dumbbell 520 may detect exercise data using sensor data which is acquired through the at least one sensor for detecting a motion of the dumbbell 520. The dumbbell 520 may transmit the exercise data to an external device (for example, the electronic device 201) by the medium of a body of a user who is in contact with the handle 524.

Figure 5D:
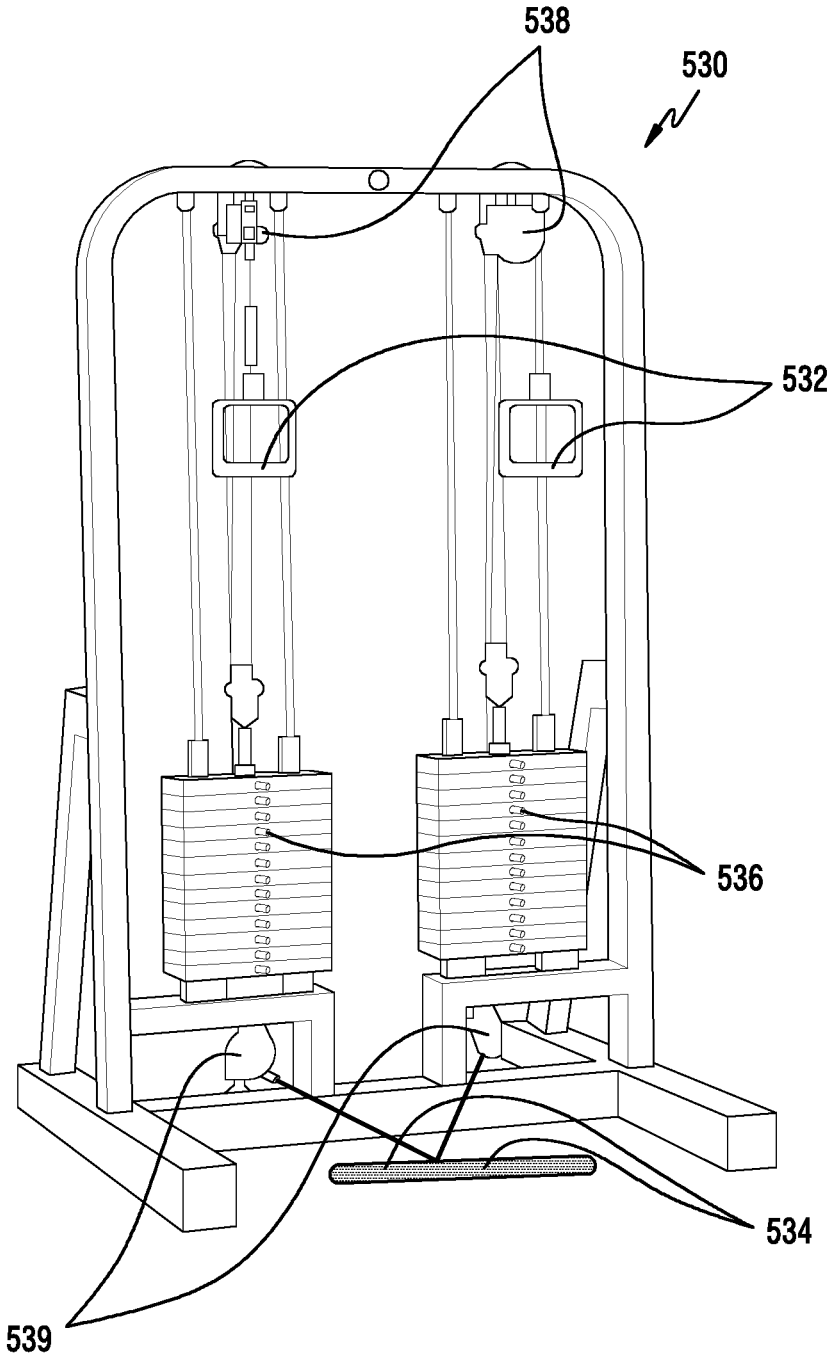

According to one example embodiment, as shown in FIG. 5D, a butterfly machine 530 may include a frame configured to support weights, at least one weight, and at least one handle 532, 534 for handling the weight. For example, the frame may be connected with the at least one weight through at least one wire, and the at least one weight may move up and down through the wire. For example, the first handle 532 may be arranged on an upper end of the frame so as to allow a user to lift the at least one weight in a standing posture. At least a portion of the first handle 532 may be formed of a conductive component such as metal so as to enable human body communication. The frame may include a rotary member 538 arranged on an upper end of the frame so as to enable the weight to be moved by the first handle 532. For example, the rotary member 538 may further include at least one sensor (for example, the sensor 280' of FIG. 2B) to detect a rotation speed and the number of times of rotation of the weight. For example, the second handle 534 may be arranged on a lower end of the frame so as to allow a user to lift the at least one weight in a sitting posture. At least a portion of the second handle 534 may be formed of a conductive component such as metal so as to enable human body communication. The frame may include a rotary member 539 arranged on a lower end of the frame so as to enable the weight to be moved by the second handle 534. For example, the rotary member 539 may further include at least one sensor (for example, the sensor 280' of FIG. 2B) to detect a rotation speed and the number of times of rotation of the weight. For example, the weight may further include at least one sensor 536 (for example, the sensor 280' of FIG. 2B) to detect a weight for a user's exercise. For example, the butterfly machine 530 may detect exercise data using sensor data which is acquired through the at least one sensor 536 connected to the weight and the at least one sensor connected to the rotary member 538. The butterfly machine 530 may transmit the exercise data to an external device (for example, the electronic device 201 of FIG. 2) by the medium of a body of a user who is in contact with the handle 532, 534.

Figure 5E:
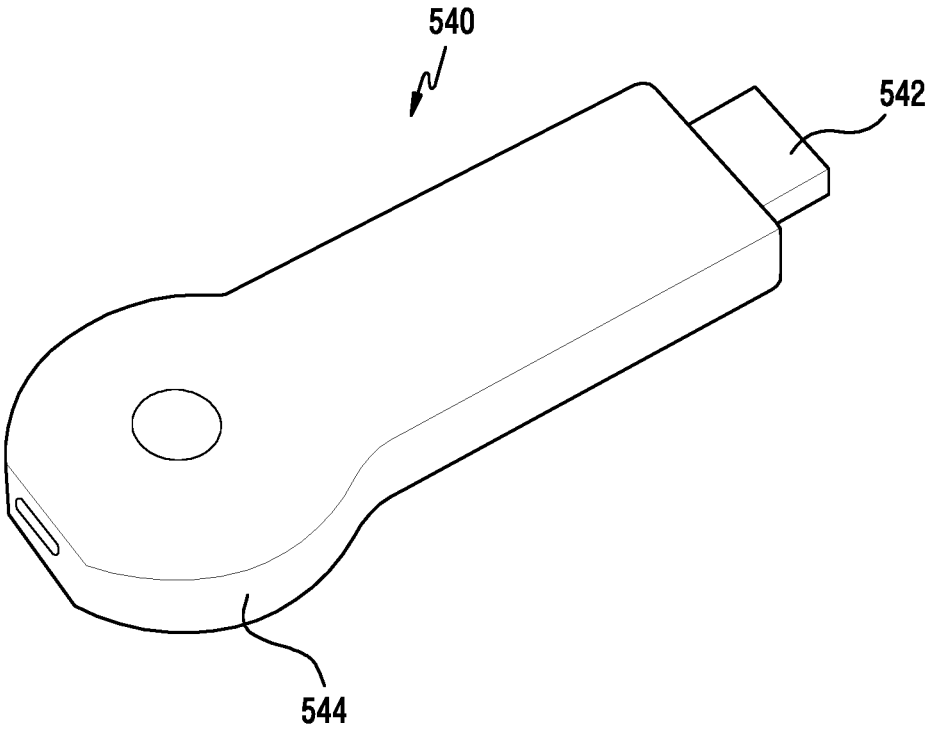

According to one example embodiment, as shown in FIG. 5E, exercise equipment may perform human body communication with an external device (for example, a user terminal) using a human body communication module 540. For example, the human body communication module 540 may be formed in an accessory type, and may include a connection region 542 which is connected to the exercise equipment, and a contact region 544 which can be contacted by a user so as to perform communication by the medium of the user's body.

According to various example embodiments of the present disclosure, an electronic device may include: a human body communication module; a conductive member electrically connected with the human body communication module and exposed to the outside (e.g., externally exposed); and at least one processor. The at least one processor may be configured to detect a user's contact through the conductive member, to control the human body communication module to transmit at least one piece of user information to an external device through a body of the user, and, when exercise information is received from the external device, to store the exercise information.

According to example various embodiments, the electronic device may further include at least one sensor, and the at least one processor may be configured to determine whether a motion of the electronic device is generated through the at least one sensor, and, when the motion of the electronic device is generated, to control the human body communication module to transmit the at least one piece of user information through the body of the user.

According to various example embodiments, the at least one processor may be configured to, when authentication success information is received through the body of the user which is in contact with the electronic device, set recommended exercise information corresponding to the user, and to control the human body communication module to transmit the recommended exercise information to the external device through the body of the user.

According to various example embodiments, the at least one processor may be configured to set the recommended exercise information corresponding to the user based on at least one of the user information and an exercise history.

According to various example embodiments, the at least one processor may be configured to periodically receive the exercise information through the body of the user when the user's contact is maintained through the conductive member.

According to various example embodiments, the electronic device may further include a short range communication module, and the at least one processor may be configured to receive the exercise information from the external device through the short range communication module.

According to various example embodiments, the electronic device may further include a display, and the at least one processor may be configured to control the display to display the exercise information.

According to various example embodiments, the electronic device may include a wearable device.

According to various example embodiments of the present disclosure, exercise equipment may include: at least one sensor; a human body communication module; a conductive member electrically connected with the human body communication module and exposed to the outside (e.g., externally exposed); and at least one processor. The at least one processor may be configured to detect a user's contact through the conductive member, to receive at least one piece of user information of an external device through a body of the user using the human body communication module, and, when authentication of the user succeeds based on the at least one piece of user information from the external device, to collect exercise information of the user through the at least one sensor.

According to various example embodiments, the at least one processor may be configured to set the exercise equipment to correspond to recommended exercise information when the recommended exercise information is received through the body of the user.

According to various example embodiments, the at least one processor may be configured to, when the authentication of the user succeeds, set recommended exercise information corresponding to the user based on at least one of the user information and an exercise history, and to set the exercise equipment to correspond to the recommended exercise information.

According to various example embodiments, the at least one processor may be configured to detect whether the exercise of the user on the exercise equipment is finished based on at least one of contact information of the user through the conductive member and driving information of the exercise equipment.

According to various example embodiments, the human body communication module may be attachable to and detachable from the exercise equipment.

Figure 6A:
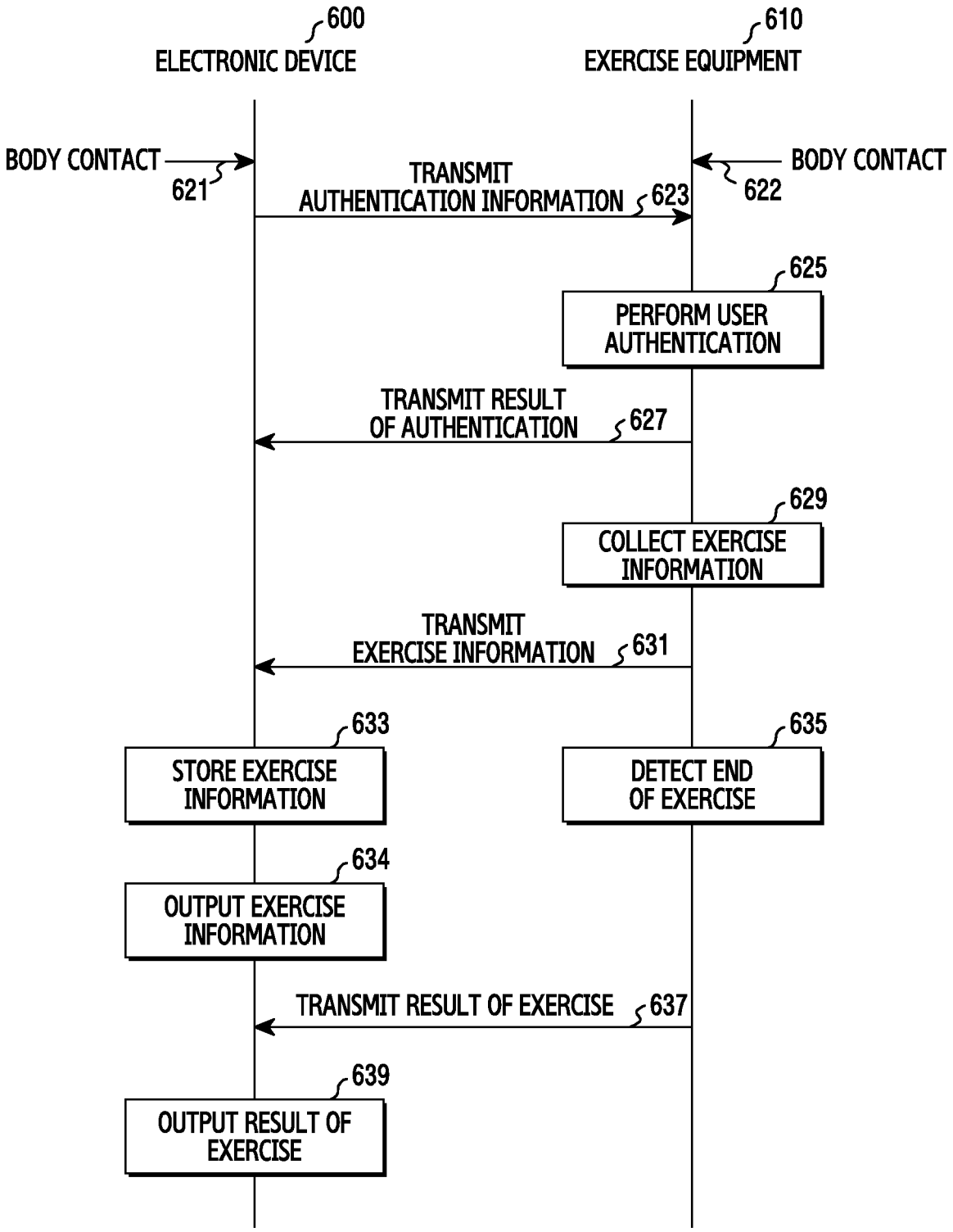
FIG. 6A is a signal flow chart for transmitting authentication information through human body communication according to various example embodiments of the present disclosure.

FIG. 6A is a signal flowchart for transmitting authentication information through human body communication according to various example embodiments of the present disclosure.

Referring to FIG. 6A, an example exercise system may include an electronic device 600 and exercise equipment 610.

According to one example embodiment, the electronic device 600 may transmit authentication information of the electronic device 600 by the medium of a body of a user (623). For example, when a user's body contact is detected (621), the electronic device 600 may transmit the authentication information of the electronic device 600 by the medium of the body of the user. For example, when an authentication request signal is received from the exercise equipment 610 by the medium of the body of the user, the electronic device 600 may transmit the authentication information of the electronic device 600 to the exercise equipment 610 through the body of the user.

According to one example embodiment, the exercise equipment 610 may perform authentication with respect to the electronic device 600 (or the user of the electronic device 600) based on the authentication information of the electronic device 600 received by the medium of the body of the user (625). For example, when body contact of the user is detected (622), the exercise equipment 610 may transmit the authentication request signal to the electronic device 600 by the medium of the body of the user. In response to the authentication request signal, the exercise equipment 610 may receive the authentication information of the electronic device 600 by the medium of the body of the user. The exercise equipment 610 may authenticate the electronic device 600 by comparing the authentication information of the electronic device 600 and reference information already registered for user authentication. When the authentication of the electronic device 600 succeeds, the exercise equipment 610 may transmit the result of authentication (for example, success) to the electronic device 600 through the body of the user (627).

According to one example embodiment, when the authentication of the electronic device 600 succeeds, the exercise equipment 610 may collect user's exercise information (629). For example, the exercise equipment 610 may detect user's exercise information based on driving information (motion information) of the exercise equipment 610 driven by the user.

According to one embodiment, the exercise equipment 610 may transmit the exercise information to the electronic device 600 through the body of the user (631). For example, when the user's body contact is maintained, the exercise equipment 610 may periodically transmit the user's exercise information to the electronic device 600 through the body of the user. For example, the exercise equipment 610 may extract at least a portion (for example and without limitation, at least one of an exercise time, the number of times of exercising, a distance, and burned calories) of the user's exercise information collected at the exercise equipment 610, and may transmit the extracted information to the electronic device 600.

According to one example embodiment, the electronic device 600 may store the exercise information received from the exercise equipment 610 through the body of the user (633). For example, the electronic device 600 may output the exercise information received from the exercise equipment 610 to the outside (634). For example, the electronic device 600 may output the exercise information in the form of at least one of graphic, a sound, and a vibration.

According to one embodiment, when the end of the user's exercise is detected (635), the exercise equipment 610 may collect the result of exercising and transmit the result to the electronic device 600 (637). For example, when the body contact of the user is not detected even after a reference time elapses or an input to an end button is detected, the exercise equipment 610 may determine that the user's exercise is finished. For example, the exercise equipment 610 may transmit the user's exercise information to the electronic device 600 using the body of the user and/or using radio resources.

According to one example embodiment, the electronic device 600 may output the exercise information received from the exercise equipment 610 to the outside (639).

Figure 6B:
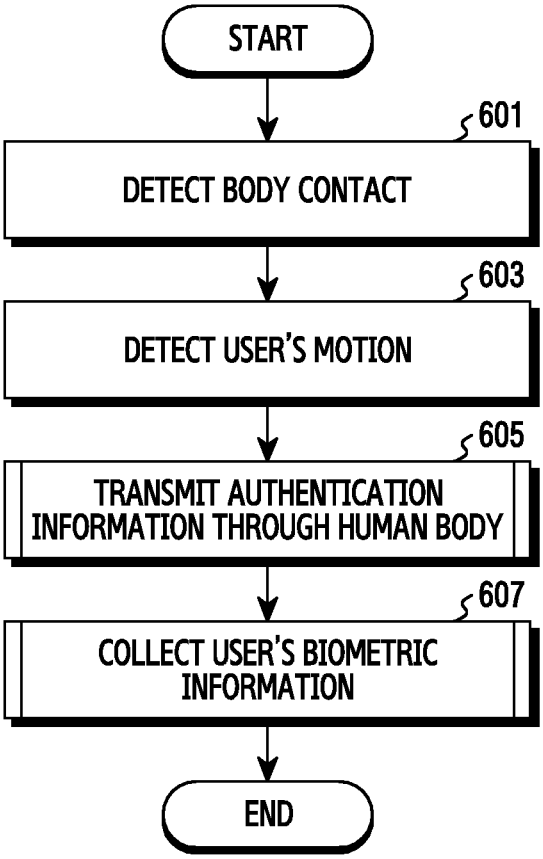
FIG. 6B is a flowchart for transmitting authentication information in an electronic device according to various example embodiments of the present disclosure.

FIG. 6B is a flowchart for transmitting authentication information in an electronic device according to various example embodiments of the present disclosure. In the following description, the electronic device may include the electronic device 201 of FIG. 2 or at least a portion (for example, the processor 220) of the electronic device 201.

Referring to FIG. 6B, in operation 601, the electronic device may detect body contact with a user. For example, the processor 220 may determine whether a body of the user contacts the electronic device based on a current change (or a change in a resistance value) detected through an electrode which is electrically connected to the communication interface 240 and leads to the surface of the electronic device 201.

In operation 603, the electronic device may detect a motion made by the user who is in contact with the electronic device. For example, the processor 220 may determine whether a motion of the electronic device 201 is detected through the sensor 280 while the user's body contact is maintained. When a motion greater than or equal to a reference size is detected through the sensor 280 while the user's body contact is maintained, the processor 220 may determine that the electronic device 201 is worn on the user.

When it is determined that the electronic device is worn on the user, the electronic device may transmit authentication information through the body of the user in operation 605. For example, the processor 220 may control the communication interface 270 (for example, the human body communication module) to transmit user's identification information pre-stored in the memory 230 through a body 272 of the user which is in contact with the electronic device 201. For example, when it is determined that the electronic device 201 is worn on the user, the processor 220 may activate at least a portion (for example, the human body communication module) of the communication interface 270 for performing human body communication. For example, the processor 220 may activate at least a portion (for example, the human body communication module) of the communication interface 270 for performing human body communication based on situation information of the electronic device 201. The situation information of the electronic device 201 may include at least one of a place (for example, a location of the electronic device 201), a person (for example, a person wearing the electronic device 201), a thing, and equipment.

In operation 607, the electronic device may collect biometric information obtained during a user's exercise. For example, when the user's authentication information is transmitted to an external device (for example, exercise equipment) by the medium of the body 272 of the user, the processor 220 may collect biometric change information of the user through the at least one sensor 280. According to one example embodiment, when authentication success information is received from the external device through the body 272 of the user, the processor 220 may collect biometric change information (e.g., pulse rate) of the user through the at least one sensor 280. For example, the processor 220 may estimate (detect) an amount of exercise of the user based on the biometric change information.

According to various example embodiments of the present disclosure, when contact with the body of the user is detected, the electronic device may transmit authentication information through the body of the user based on body contact information. For example, the processor 220 may detect body contact with the user. The processor 220 may transmit authentication information stored in the memory 230 to an external device through the body 272 of the user which is in contact with the electronic device 201.

Figure 7:
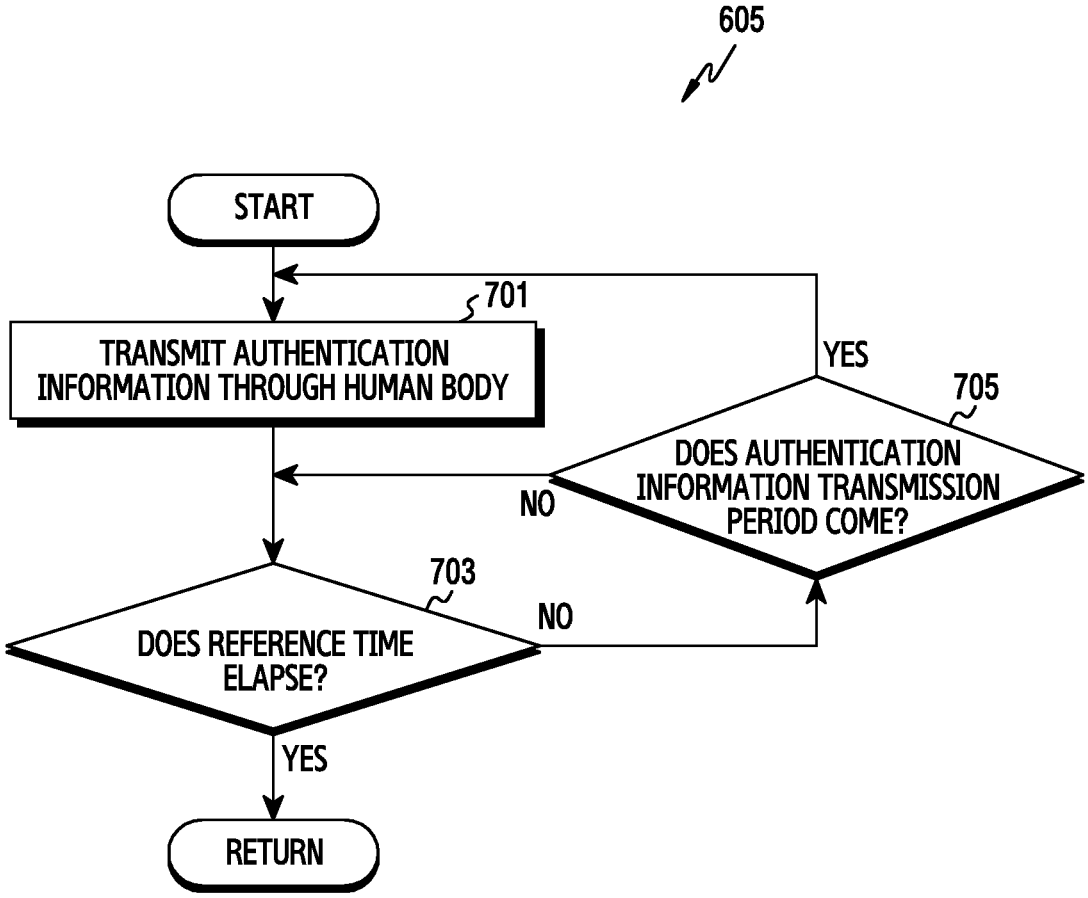
FIG. 7 is a flowchart of an example for transmitting authentication information through human body communication in an electronic device according to various example embodiments of the present disclosure.

FIG. 7 is a flowchart of an example for transmitting authentication information through human body communication in an electronic device according to various example embodiments of the present disclosure. In the following description, operation 605 in FIG. 6 of transmitting authentication information through a human body will be described. In the following description, the electronic device may include the electronic device 201 of FIG. 2 or at least a portion (for example, the processor 220) of the electronic device 201.

Referring to FIG. 7, when a motion of the electronic device made by a user is detected while the electronic device is contacted by a body of the user (for example, operation 603 of FIG. 6), the electronic device may transmit authentication information through the body of the user which is in contact with the electronic device in operation 701. For example, the processor 220 may transmit authentication information for identifying the user (or the electronic device 201), which is stored in the memory 230, through human body communication using the body 272 of the user contacting the electronic device 201 as a medium. For example, the authentication information may include at least one of user's unique identification information (for example, a phone number), application identification information, unique identification information (for example, membership information) allocated to a user in a specific place, and a certain value.

In operation 703, the electronic device may determine whether a reference time elapses from an initial time that the authentication information is transmitted using the body of the user. For example, when the authentication information is initially transmitted through the body of the user, the processor 220 may activate a first timer which is driven for a reference time. The processor 220 may determine whether the driving time of the first timer expires. For example, the driving of the first timer may be finished or extinguished when the reference time comes.

When the reference time does not elapse from the initial time that the authentication information is transmitted using the body of the user, the electronic device may determine whether an authentication information transmission period comes in operation 705. For example, when the authentication information is transmitted through the body of the user, the processor 220 may activate a second timer which is driven during the authentication information transmission period. The processor 220 may determine whether the driving time of the second timer expires. For example, the second timer may be reset when the processor 220 transmits the authentication information.

When the authentication information transmission period does not come, the electronic device may determine again whether the reference time elapses from the initial time that the authentication information is transmitted using the body of the user in operation 703.

When the authentication information transmission period comes, the electronic device may transmit the authentication information through human body communication using the body of the user which is in contact with the electronic device.

When the reference time elapses from the initial time that the authentication information is transmitted using the body of the user, the electronic device may finish transmitting the authentication information.

According to various example embodiments, when a response signal to the authentication information is received from an external device through human body communication, the electronic device may finish transmitting the authentication information. For example, the processor 220 may periodically control transmitting the authentication information through the body 272 of the user which is in contact with the electronic device 201 (for example, operations 701 and 705 of FIG. 7). When the response signal to the authentication information is received from exercise equipment (for example, the electronic device 204 of FIG. 2) through the body 272 of the user who contacts the electronic device 201, the processor may determine that authentication of the electronic device 201 is completed. For example, the response signal to the authentication information may include identification information of the exercise equipment which is contacted by the user.

Figure 8:
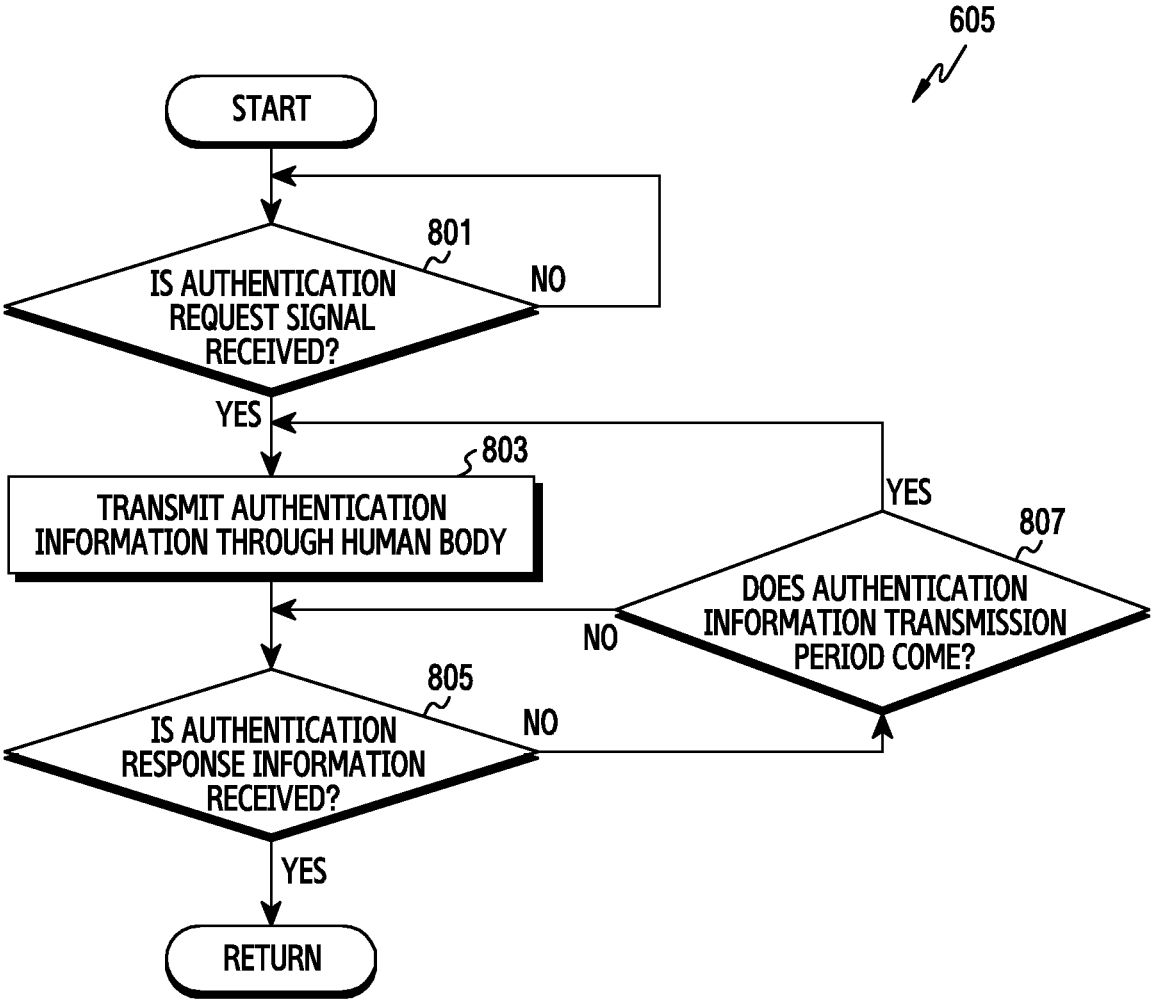
FIG. 8 is a flowchart of another example for transmitting authentication information through human body communication in an electronic device according to various example embodiments of the present disclosure.

FIG. 8 is a flowchart of another example for transmitting authentication information through human body communication in an electronic device according to various example embodiments of the present disclosure. In the following description, operation 605 in FIG. 6 of transmitting authentication information through a human body will be described. In the following description, the electronic device may include the electronic device 201 of FIG. 2 or at least a portion of the electronic device 201 (for example, the processor 220).

Referring to FIG. 8, when a motion of the electronic device made by a user is detected while the electronic device is contacted by a body of the user (for example, operation 603 of FIG. 6), the electronic device may determine whether an authentication request signal is received through the body of the user which is in contact with the electronic device in operation 801. For example, the processor 220 may determine whether an authentication request signal is received from an external device (for example, exercise equipment) through human body communication using the body 272 of the user which is in contact with the electronic device 201 as a medium.

When the authentication request signal is received through the body of the user which is in contact with the electronic device, the electronic device may transmit authentication information through the body of the user in operation 803. For example, the processor 220 may control transmitting a user's authentication information (or authentication information of the electronic device 201) stored in the memory 230 to the external device through the body 272 of the user which is in contact with the electronic device 201.

In operation 805, the electronic device may determine whether a response signal to the authentication information transmitted through the body of the user is received. For example, the processor 220 may determine whether a response signal to the authentication information is received from the external device (for example, exercise equipment) through human body communication using the body 272 of the user which is in contact with the electronic device 201 as a medium. For example, the response signal to the authentication information may include information on whether the authentication succeeds and identification information of the external device.

When the response signal to the authentication information transmitted through the body of the user is not received, the electronic device may determine whether an authentication information transmission period comes in operation 807. For example, the processor 220 may determine whether a driving time of a timer driven based on transmission of authentication information using the body 272 of the user expires. When the driving time of the timer expires, the processor 220 may determine that the authentication information transmission period comes. For example, the timer may be reset when the processor 220 transmits the authentication information through the body 272 of the user.

When the authentication information transmission period does not come, the electronic device may determine again whether a response signal to the authentication information transmitted through the body of the user is received in operation 805.

When the authentication information transmission period comes, the electronic device may transmit the authentication information again through the body of the user which is in contact with the electronic device.

When the response signal to the authentication information transmitted through the body of the user is received, the electronic device may finish transmitting the authentication information. For example, when the response signal to the authentication information is received from the external device through the body 272 of the user which is in contact with the electronic device 201, the processor 220 may determine that the authentication of the electronic device 201 is completed. Accordingly, the processor 220 may finish transmitting the authentication information using the body of the user.

Figure 9:
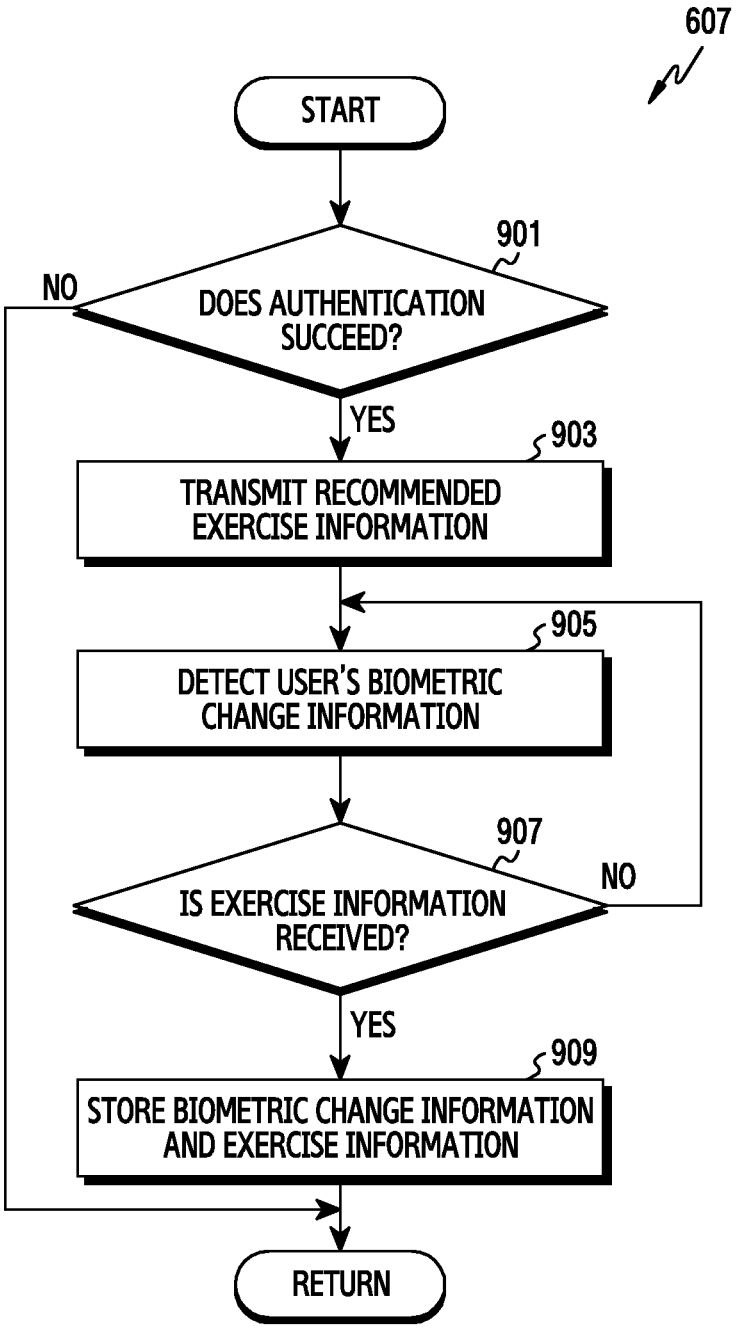
FIG. 9 is a flowchart for managing user's biometric information and exercise information in an electronic device according to various example embodiments of the present disclosure.

FIG. 9 is a flowchart for managing biometric information and exercise information of a user in an electronic device according to various example embodiments of the present disclosure. In the following description, operation 607 in FIG. 6 of collecting user's biometric information will be described. In the following description, the electronic device may include the electronic device 201 of FIG. 2 or at least a portion of the electronic device 201 (for example, the processor 220).

Referring to FIG. 9, when a user's authentication information (or authentication information of the electronic device) is transmitted through a body of the user which is in contact with the electronic device (for example, operation 605 of FIG. 6), the electronic device may determine whether authentication of the user succeeds in an external device in operation 901. For example, when the user's authentication information is transmitted to an external device (for example, exercise equipment) through the body 272 of the user which is in contact with the electronic device 201, the processor 220 may determine whether a response signal to the authentication information is received from the external device. When the response signal to the authentication information is received through the body 272 of the user which is in contact with the electronic device 201, the processor 220 may determine whether the authentication of the user succeeds based on the response signal. For example, when the response signal to the authentication information includes identification information of the external device, the processor 220 may determine that the authentication of the user succeeds in the external device.

When the authentication of the user succeeds in the external device, the electronic device may transmit recommended exercise information corresponding to the user to the external device in operation 903. For example, when the authentication of the user succeeds in the external device, the processor 220 may extract at least one of user's personal information and a user's exercise history from the memory 230. The processor 220 may determine a recommended exercise program corresponding to at least one of the user's personal information and the user's exercise history and the identification information of the external device. The processor 220 may transmit the recommended exercise program information to the external device (for example, exercise equipment) through the body 272 of the user which is in contact with the electronic device 201. For example, the personal information may include at least one of age, sex, biometric information, and a disease history of the user. According to one example embodiment, the processor 220 may map the identification information of the external device and the recommended exercise program information, and may store the mapped information in at least a region of the memory 230.

In operation 905, the electronic device may detect user's biometric change information. For example, when the recommended exercise information is transmitted, the processor 220 may determine that a user's exercise starts. Accordingly, the processor 220 may collect user's biometric change information according to the recommended exercise information using at least one sensor 280 contacting the body of the user. For example, the biometric change information may include change information of at least one of a heartbeat, blood pressure, and oxygen saturation.

In operation 907, the electronic device may determine whether exercise information is received from the external device. For example, the processor 220 may determine whether exercise information is received through the body 272 of the user contacting the electronic device by means of an electrode electrically connected to the communication interface 240.

When the exercise information is not received from the external device, the electronic device may continuously detect user's biometric change information in operation 905. For example, when user's biometric data is not changed even after a reference time elapses or is continuously stabilized for the reference time, the processor 220 may determine that the user's exercise is finished.

When the exercise information is received from the external device, the electronic device may match the user's biometric change information and the exercise information and store the matched information in operation 909. For example, when the exercise information is received through the body 272 of the user contacting the electronic device by means of the electrode electrically connected to the communication interface 240, the processor 220 may match the user's biometric change information which is collected through the at least one sensor 280 at a corresponding time and the exercise information, and may store the matched information in the memory 230. For example, the exercise information may include information of at least one of an exercise time, the number of times of exercising, a distance, and burned calories as at least a portion of the exercise information detected at the external device (for example, exercise equipment).

Figure 10:
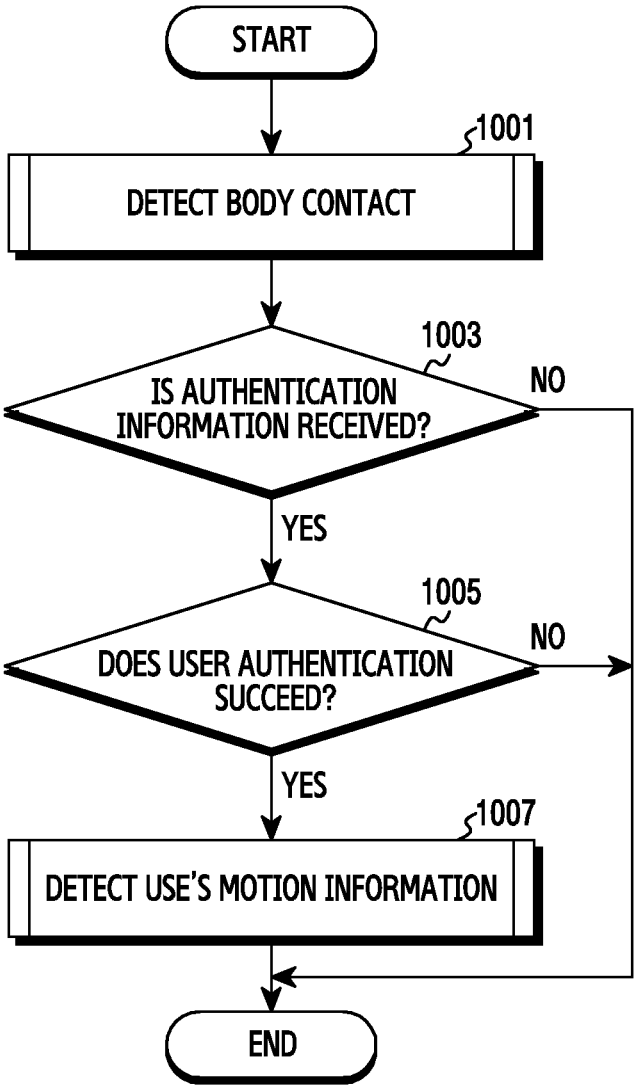
FIG. 10 is a flowchart for detecting user's motion information in exercise equipment according to various example embodiments of the present disclosure.

FIG. 10 is a flowchart for detecting motion information of a user in exercise equipment according to various example embodiments of the present disclosure.

Referring to FIG. 10, the exercise equipment may detect body contact of a user in operation 1001. For example, the processor 220 may detect contact of the body 272 of the user through an electrode (for example, a handle) leading from the communication interface 270' to the surface of the exercise equipment. According to one example embodiment, the processor 220' may determine whether an authentication event is generated based on body contact information which is detected through the electrode (for example, the handle) leading from the communication interface 270' to the surface of the exercise equipment. When it is determined that the authentication event is generated, the processor 220' may determine that contact for a user's exercise is generated. For example, the body contact information may include at least one of the number of times the user contacts for a reference time and a contact holding time.

In operation 1003, the exercise equipment may determine whether authentication information is received through the body of the user which is in contact with the exercise equipment. For example, the processor 220' may determine whether authentication information of the electronic device (for example, the electronic device 201 of FIG. 2) is received through the body 272 of the user which is in contact with the exercise equipment.

When the authentication information is received through the body of the user which is in contact with the exercise equipment, the exercise equipment may determine whether the user corresponding to the authentication information received through the body of the user can be authenticated in operation 1005. For example, the processor 220' may compare the authentication information received through the body 272 of the user and at least one piece of reference information pre-stored in the memory 230'. When there exists reference information matching the authentication information received through the body 272 of the user, the processor 220' may determine that the authentication of the user corresponding to the authentication information succeeds. According to one example embodiment, when the authentication of the user succeeds, the processor 220' may control the display 260' to display user information.

When the user corresponding to the authentication information is not authenticated, the exercise equipment may determine not to support an exercise service for the corresponding user. In this case, the exercise equipment may be driven by a user's operation on a button, but may put a limit to providing an exercise service such as automatically setting a recommended exercise program and collecting exercise information through human body communication.

When the authentication of the user corresponding to the authentication information received through the body of the user succeeds, the exercise equipment may detect motion information according to a user's exercise in operation 1007. For example, when the authentication of the user corresponding to the authentication information received through the body 272 of the user succeeds, the processor 220' may determine to support an exercise service for the corresponding user. The processor 220' may determine a recommended exercise program corresponding to the user. For example, the processor 220' may receive recommended exercise program information through the body 272 of the user which is in contact with the exercise equipment. For example, the processor 220 of the electronic device may determine a recommended exercise program based on at least one of an exercise history and personal information, which corresponds to the successfully authenticated user and is detected from the memory 230. The processor 220' may set at least one of an exercise course, the number of times of exercising, a weight, and a time of the exercise equipment to correspond to the recommended exercise program corresponding to the user. The processor 220' may collect a user's motion information corresponding to the recommended exercise program.

Figure 11:
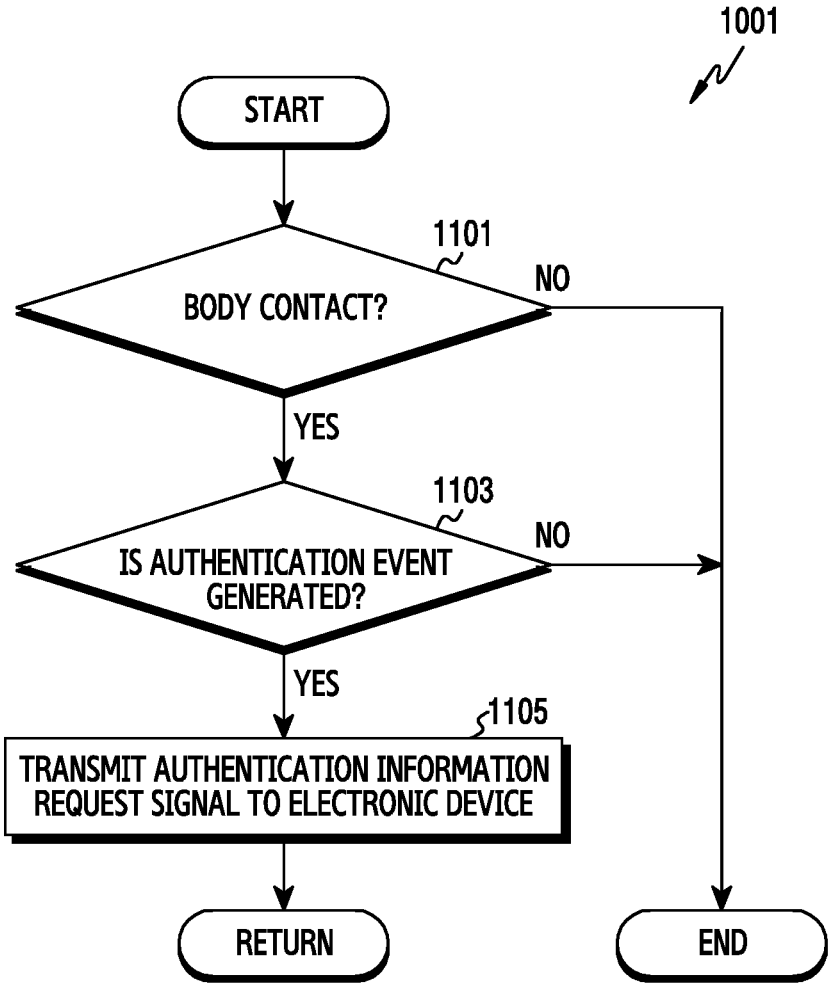
FIG. 11 is a flowchart for receiving authentication information through human body communication in exercise equipment according to various example embodiments of the present disclosure.

FIG. 11 is a flowchart for receiving authentication information through human body communication in exercise equipment according to various example embodiments of the present disclosure. In the following description, operation 1001 in FIG. 10 of detecting body contact will be described.

Referring to FIG. 11, in operation 1101, the exercise equipment may determine whether a body of a user is in contact with the exercise equipment through at least a region (for example, a handle) of the exercise equipment that is formed of a conductive member for human body communication. For example, in the case of the treadmill 500 of FIG. 5A, the processor 220' may determine whether the body 272 of the user is in contact with the treadmill 500 through the handles 504. For example, the processor 220 may determine whether the body 272 of the user is in contact with the treadmill 500 based on a current change (or a change in the resistance value) acquired through the conductive member(s) 506 of the handle(s) 504.

When the user's contact with the exercise equipment is detected, the exercise equipment may determine whether an authentication event is generated based on user's contact information in operation 1103. For example, the processor 220' may determine whether an authentication event is generated based on at least one of the number of times the user contacts and a contact holding time that is acquired through the handles 504 of the treadmill 500 as shown in FIG. 5A.

When user's body contact is not generated or the generation of an authentication event is not detected, the exercise equipment may determine not to provide an exercise service corresponding to the user. In this case, the exercise equipment may be driven by a user's operation on a button, but may put a limit to providing an exercise service such as automatically setting a recommended exercise program corresponding to the user who is authenticated through human body communication and collecting exercise information.

When the generation of the authentication event is generated based on the user's contact information, the exercise equipment may transmit an authentication information request signal through the body of the user which is in contact with the exercise equipment in operation 1105. For example, when it is determined that the authentication event is generated based on the user's contact information acquired through the handles 504 of the treadmill 500, the processor 220' may transmit the authentication information request signal through the body 272 of the user which is in contact with the handles 504.

Figure 12:
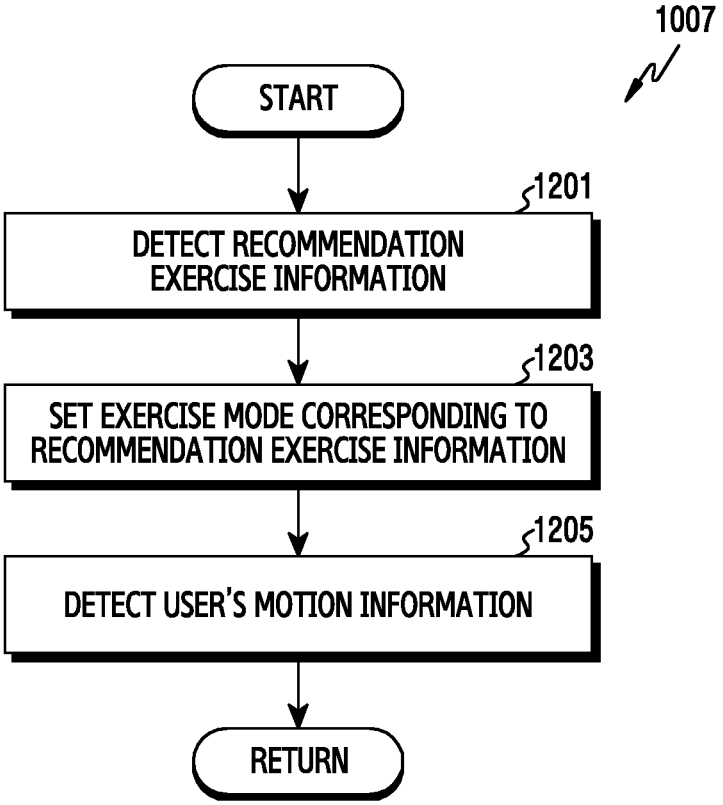
FIG. 12 is a flowchart for detecting user's exercise information in exercise equipment according to various example embodiments of the present disclosure.

FIG. 12 is a flowchart for detecting user's exercise information in exercise equipment according to various example embodiments of the present disclosure. In the following description, operation 1007 in FIG. 10 of detecting (collecting) user's motion information will be described.

Referring to FIG. 12, when the authentication of the user corresponding to the corresponding authentication information succeeds using the authentication information acquired through the body of the user which is in contact with the exercise equipment (for example, operation 1005 of FIG. 10), the exercise equipment may detect recommended exercise information corresponding to the user in operation 1201. For example, the processor 220 may receive recommended exercise program information corresponding to the user through the body 272 of the user which is in contact with the exercise equipment. For example, the processor 220' may detect at least one of an exercise history and personal information corresponding to the user who is successfully authenticated from the memory of a management device in communication with the exercise equipment. The processor 220' may determine a recommended exercise program corresponding to the user based on at least one of the exercise history and the personal information corresponding to the user. For example, the processor 220' may control transmitting identification information of the user who is successfully authenticated to a management device connecting communication with the exercise equipment. The processor 220' may receive the recommended exercise program information corresponding to the user who is successfully authenticated from the management device. For example, the recommended exercise program may include at least one of an exercise course, the number of times of exercising, a weight, and a time of the exercise equipment. The processor 220' may also receive the recommended exercise program by a communication from electronic device 201 through the human body 272.

In operation 1203, the exercise equipment may set an exercise mode of the exercise equipment to correspond to the recommended exercise information. For example, in the case of the treadmill 500 of FIG. 5A, the processor 220' may set an exercise course, an exercise speed, and an exercise time corresponding to the recommended exercise program information. For example, in the case of the bike 510 of FIG. 5B, the processor 220' may set an exercise course and an exercise time corresponding to the recommended exercise program information. For example, in the case of the dumbbell 520 of FIG. 5C, the processor 220' may set an exercise weight and the number of times of exercising corresponding to the recommended exercise program information. For example, in the case of the butterfly machine 550 of FIG. 5D, the processor 220' may set an exercise weight and the number of times of exercising corresponding to the recommended exercise program information.

In operation 1205, the exercise equipment may collect user's exercise information corresponding to the recommended exercise information. For example, in the case of the treadmill 500 of FIG. 5A, the processor 220' may drive the running conveyer belt (tread) to correspond to the exercise course and the exercise speed corresponding to the recommended exercise program. The processor 220' may collect user's exercise information corresponding to the motion of the running conveyer belt.

Figure 13:
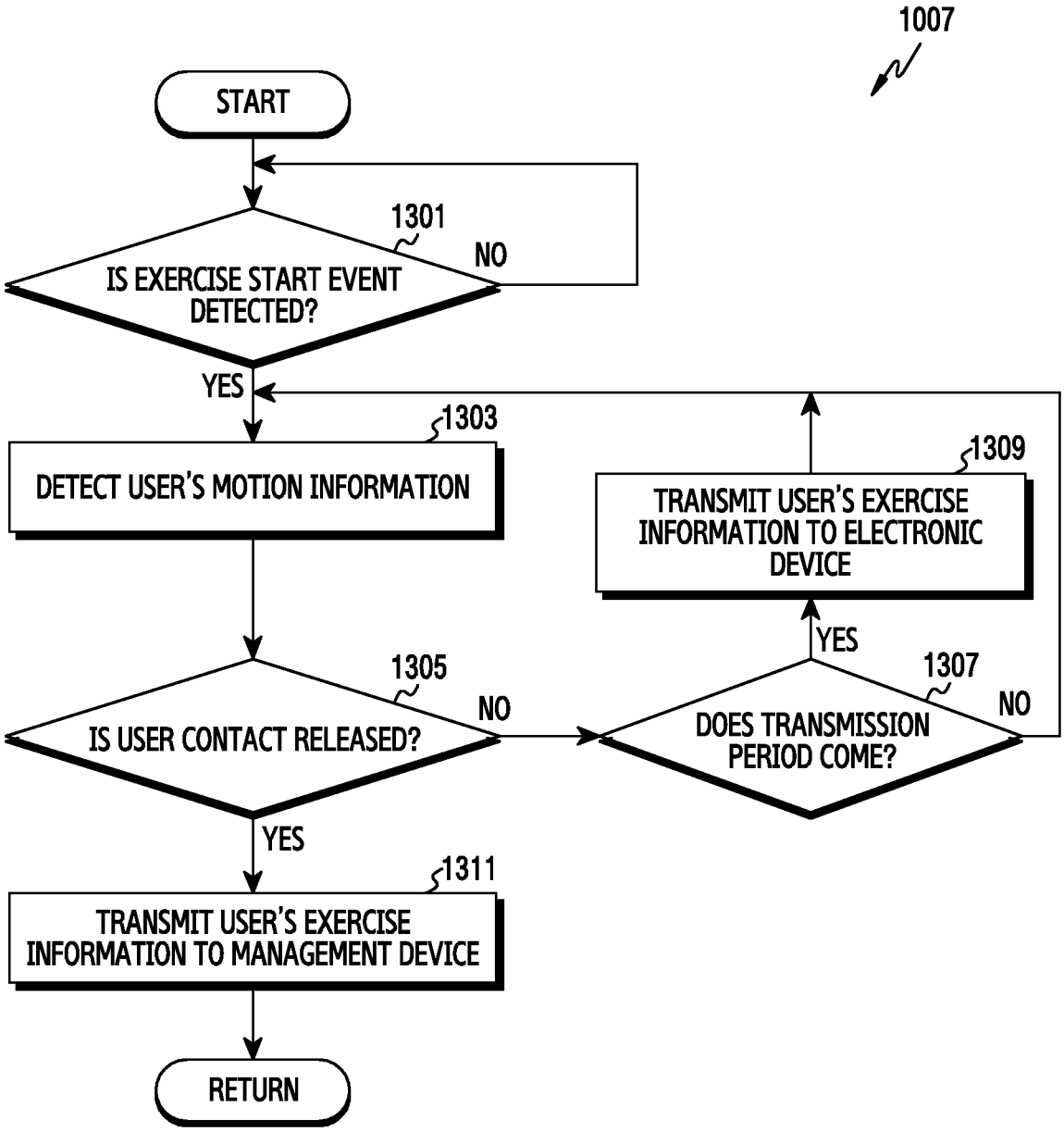
FIG. 13 is a flowchart of an example for providing user's exercise information in exercise equipment according to various example embodiments of the present disclosure.

FIG. 13 is a flowchart of an example for providing user's exercise information in exercise equipment according to various example embodiments of the present disclosure. In the following description, operation 1007 in FIG. 10 of detecting (collecting) user's motion information will be described.

Referring to FIG. 13, when the authentication of the user corresponding to the corresponding authentication information succeeds using the authentication information acquired through the body of the user which is in contact with the exercise equipment (for example, operation 1005 of FIG. 10), the exercise equipment may determine whether an exercise start event is detected in operation 1301. For example, when the authentication of the user who is in contact with the exercise equipment succeeds, the processor 220' may determine that an exercise start event corresponding to the user is generated. For example, when the authentication of the user who is in contact with the exercise equipment succeeds, the processor 220' may determine whether an exercise start event is generated based on body contact information of the user with the exercise equipment. For example, the body contact information may include at least one of the number of times the user contacts and a contact holding time that is detected during a reference time. For example, when the authentication of the user who is in contact with the exercise equipment succeeds, the processor 220' may determine whether an input to an exercise button is detected. For example, when the input to the exercise button is detected, the processor 220 may determine that an exercise start event corresponding to the user is generated.

When the generation of the exercise start event corresponding to the successfully authenticated user is detected, the exercise equipment may detect a user's exercise information corresponding to a user's operation on the exercise equipment in operation 1303. For example, in the case of the bike 510 of FIG. 5B, the processor 220' may collect user's exercise information corresponding to rotation information of the rotary plate 518 rotated by the pedals. For example, in the case of the dumbbell 520 of FIG. 5C, the processor 220' may collect user's exercise information corresponding to motion information of the dumbbell 520.

In operation 1305, the exercise equipment may determine whether the user's contact with the exercise equipment is released. For example, in the case of the bike 510 of FIG. 5B, the processor 220' may determine whether the user's contact with the handles 511 or 513 is released. For example, in the case of the dumbbell 520 of FIG. 5C, the processor 220' may determine whether the user's contact with the handle 524 of the dumbbell 520 is released.

When the user's contact with the exercise equipment is maintained, the exercise equipment may determine whether a period for transmitting exercise information comes in operation 1307. For example, when the generation of the exercise start event is detected, the processor 220' may activate a timer which is driven during the exercise information transmission period. The processor 220' may determine whether the driving time of the corresponding timer expires. For example, when the driving time of the timer expires, the processor 220' may determine that the exercise information transmission period comes. For example, the timer may be reset when the processor 220' transmits exercise information through the body 272 of the user.

When the exercise information transmission period comes, the exercise equipment may transmit at least a portion of the user's exercise information collected at the exercise equipment through the body of the user which is in contact with the exercise equipment in operation 1309. For example, the processor 220' may control transmitting user's exercise information which is collected after a previous exercise information transmission period to the electronic device 201 through human body communication. For example, the processor 220' may control transmitting a user's exercise information which is collected from an exercise start point of time of the user to the electronic device 201 through human body communication. According to one example embodiment, the processor 220' may extract at least a portion of the exercise information collected at the exercise equipment and transmit the extracted information to the electronic device 201 through the body 272 of the user. For example, at least a portion of the exercise information transmitted to the electronic device 201 through the body 272 of the user may include at least one of an exercise time, the number of times of exercising, a distance, and burned calories.

When the exercise information transmission period does not come or the exercise information is transmitted to the electronic device, the exercise equipment may continuously detect user's exercise information on the exercise equipment in operation 1303.

When the user's contact with the exercise equipment is released, the exercise equipment may transmit the user's exercise information to a management device in operation 1311. For example, when the user's body contact with the exercise equipment is released, the processor 220' may determine that the use of the exercise equipment is finished or stopped. Accordingly, the processor 220 may control the communication interface 270' to transmit the user's exercise information collected through the sensor 270 to the management device (for example, the electronic device 202). For example, the communication interface 270' may transmit the user's exercise information to the management device through short range wireless communication. For example, the management device may include an exercise information management server or a user's portable terminal.

According to various example embodiments of the present disclosure, the exercise equipment may determine whether the use of the exercise equipment is finished or stopped based on a user's contact release time on the exercise equipment. For example, when user's contact is detected again before a reference time elapses from the time that the user's body contact with the exercise equipment is released, the processor 220' may determine that the user's exercise is maintained. That is, when user's contact with the exercise equipment is not detected even after the reference time elapses, the processor 220' may determine that the user's exercise is finished or stopped.

Figure 14:
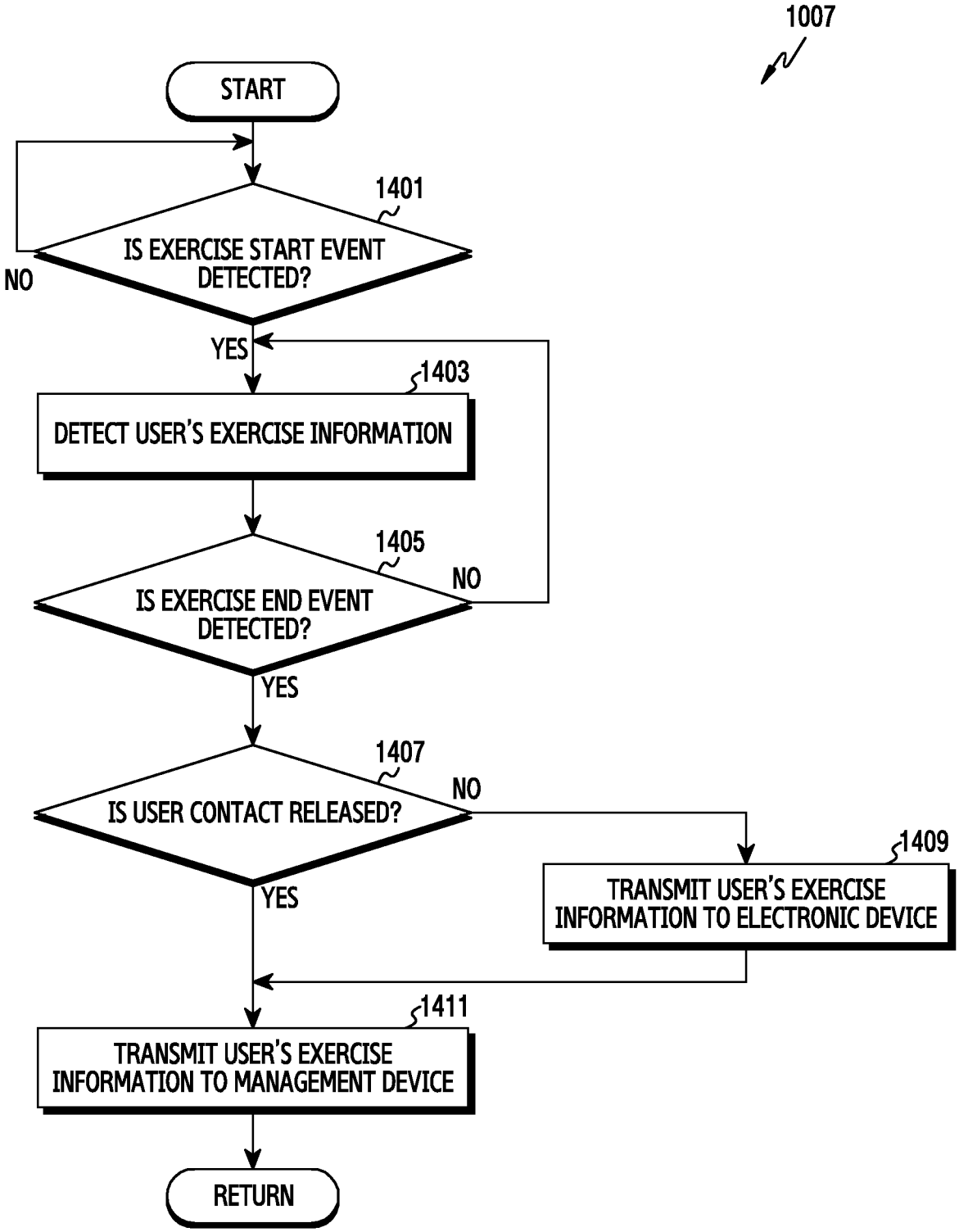
FIG. 14 is a flowchart of another example for providing user's exercise information in exercise equipment according to various example embodiments of the present disclosure.

FIG. 14 is a flowchart of another example for providing user's exercise information in exercise equipment according to various example embodiments of the present disclosure. In the following description, operation 1007 in FIG. 10 of detecting (collecting) user's motion information will be described.

Referring to FIG. 14, when the authentication of the user succeeds through human body communication of the user who is in contact with the exercise equipment (for example, operation 1005 of FIG. 10), the exercise equipment may determine whether an exercise start event is detected in operation 1401. For example, when the authentication of the user contacting the exercise equipment succeeds, the processor 220' may determine that an exercise start event corresponding to the user is generated. For example, the processor 220' may determine whether the exercise start event is generated based on body contact information of the user with the exercise equipment or an input to an exercise button. For example, when the generation of the exercise start event is detected, the processor 220' may control the communication interface 270' to transmit exercise start information to the electronic device 201 through the body of the user.

When the generation of the exercise start event corresponding to the successfully authenticated user is detected, the exercise equipment may detect user's exercise information corresponding to a user's operation on the exercise equipment in operation 1403. For example, in the case of the butterfly machine 550 of FIG. 5D, the processor 220' may collect user's exercise information corresponding to an exercise weight and rotation information of the rotary member 538 or 539.

In operation 1405, the exercise equipment may determine whether an exercise end event of the user on the exercise equipment is generated. For example, when an input to the exercise button of the exercise equipment is detected, the processor 220 may determine that the exercise end event is generated. Specifically, in the case of the treadmill 500 of FIG. 5A, when an input to the exercise button (for example, an end button) is detected while the treadmill 500 is being driven, the processor 220 may determine that the exercise end event is generated.

When the generation of the user's exercise end event on the exercise equipment is not detected, the exercise equipment may continuously collect a user's exercise information in operation 1403. For example, when the user's contact with the exercise equipment is maintained, the processor 220 may periodically transmit a user's exercise information to the electronic device 204 through the body 272 of the user.

When the generation of the exercise end event of the user on the exercise equipment is detected, the exercise equipment may determine whether the user's contact with the exercise equipment is released in operation 1407.

When the user's contact with the exercise equipment is maintained, the exercise equipment may transmit at least a portion of the user's exercise information collected at the exercise equipment to an electronic device through the body of the user which is in contact with the exercise equipment in operation 1409. For example, the processor 220 may extract at least a portion of the exercise information collected at the exercise equipment and transmit the extracted information to the electronic device 204 through the body 272 of the user.

When the user's contact with the exercise equipment is released or the exercise information is transmitted through human body communication, the exercise equipment may transmit the user's exercise information to a management device in operation 1411. For example, when it is recognized that the use of the exercise equipment is finished or stopped, the processor 220 may transmit the user's exercise information collected at the exercise equipment to the management device (for example, the electronic device 202). For example, the processor 220' may control to transmit the user's exercise information to the management device through short range wireless communication of the communication interface 270'. According to one embodiment, the electronic device may transmit the exercise information through human body communication and transmit the exercise information using short range wireless communication at the same time.

Figure 15A:
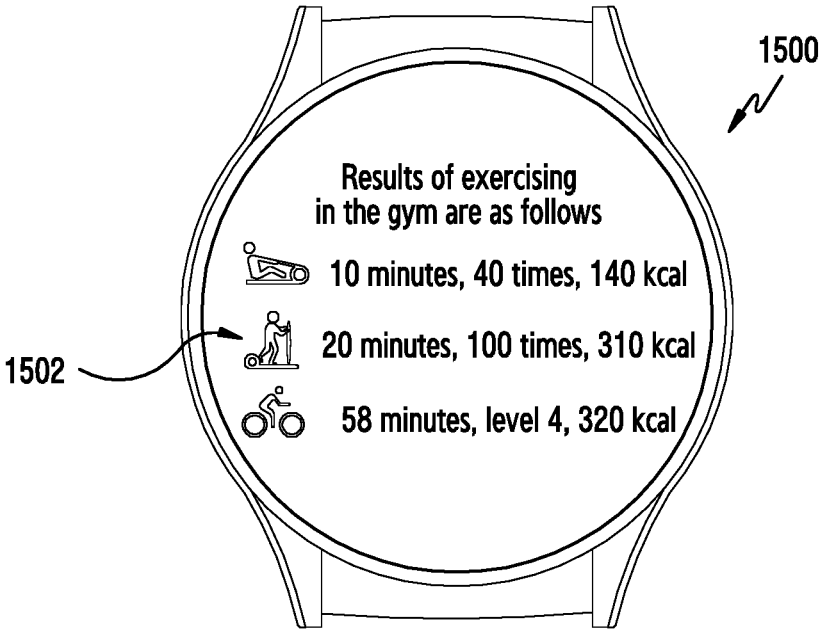
FIGS. 15A and 15B are views illustrating screen configurations of exercise information according to various example embodiments of the present disclosure.
Figure 15B:
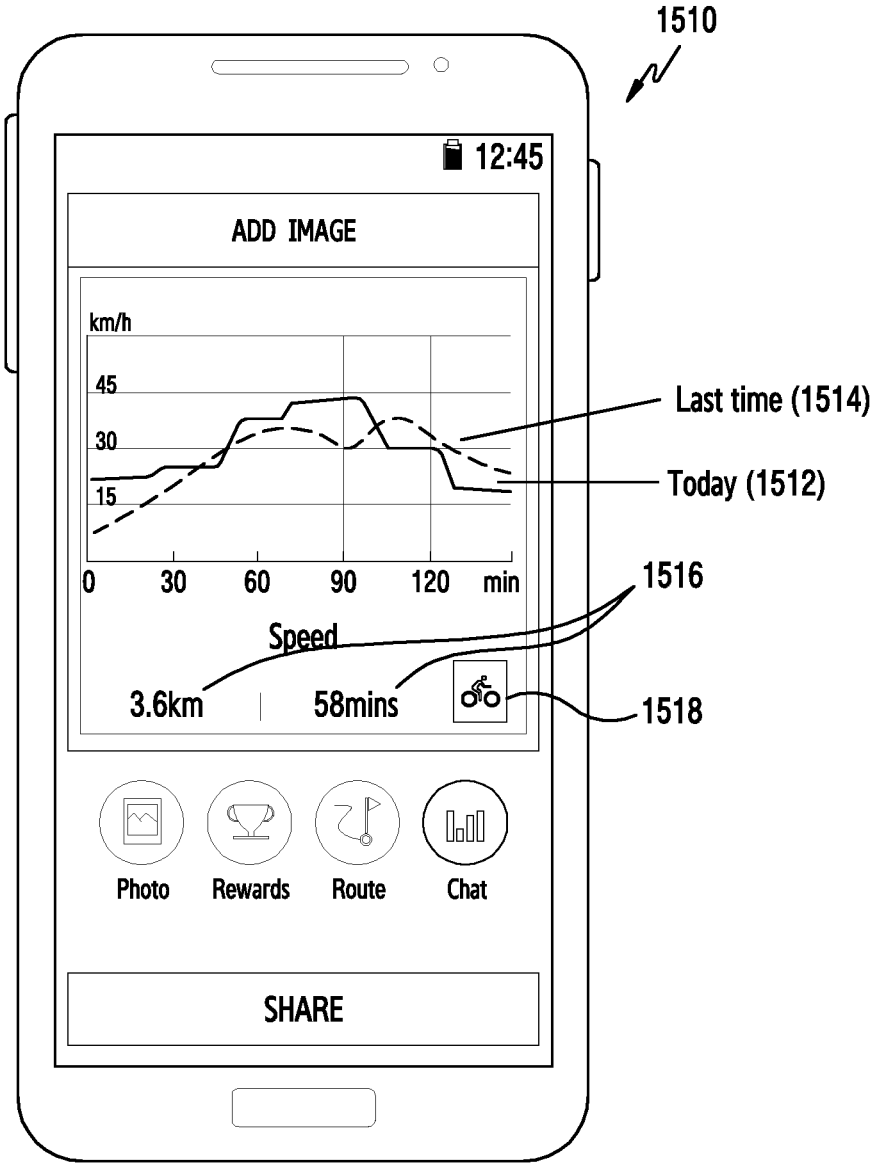

FIGS. 15A and 15B are views showing screen configurations of exercise information according to various example embodiments of the present disclosure.

According to one example embodiment, an electronic device (for example, the electronic device 201 of FIG. 2A) may receive exercise information from exercise equipment (for example, the exercise equipment) through human body communication. In this case, the electronic device may display the exercise information provided through human body communication on a display 1500 of the electronic device as shown in FIG. 15A. For example, the exercise equipment may transmit at least a portion of the exercise information collected at the exercise equipment through human body communication. When the exercise is finished or the user leaves a region where the exercise equipment is arranged (for example, a gym), the electronic device 201 may display at 1502 type of an exercise that has been performed by the user through the exercise equipment for a predetermined time (for example, today), an exercise time, and consumed calories information. The electronic device 201 may receive additional exercise data from a management device through wireless communication, and may update the exercise information provided from the exercise equipment. For example, the electronic device 201 may determine whether the user leaves the region where the exercise equipment is arranged based on at least one of satellite information, tagging information, or user's schedule information.

According to one example embodiment, a management device (for example, the electronic device 202) may receive user's exercise information from exercise equipment (for example, the exercise equipment 204) through short range wireless communication. In this case, the management device may display the exercise information provided from the exercise equipment on a display of the management device as shown in FIG. 15B. Specifically, the management device 1510 may display a user's exercise history 1512, 1514, an amount of exercise 1516, a type of an exercise 1518, and exercise efficiency which are collected at the exercise equipment on at least a portion of the display.

According to various example embodiments of the present disclosure, an operation method of an electronic device may include: detecting a user's contact through a conductive member exposed to the outside (e.g., externally exposed) of the electronic device; transmitting at least one piece of user information to an external device through a body of the user which is in contact with the electronic device; receiving exercise information from the external device; and storing the exercise information.

According to various example embodiments, transmitting the user information may include: determining whether a motion of the electronic device is generated; and, when the motion of the electronic device is generated, transmitting the at least one piece of user information through the body of the user.

According to various example embodiments, the method may further include: when authentication success information is received through the body of the user which is in contact with the electronic device, setting recommended exercise information corresponding to the user; and transmitting the recommended exercise information to the external device through the body of the user.

According to various example embodiments, setting the recommended exercise information may include setting the recommended exercise information corresponding to the user based on at least one of the user information and an exercise history.

According to various example embodiments, receiving the exercise information may include, when the user's contact is maintained, periodically receiving the exercise information from the external device through the body of the user.

According to various example embodiments, receiving the exercise information may include receiving the exercise information from the external device through wireless communication.

According to various example embodiments, outputting the exercise information may include displaying the exercise information on a display electrically connected with the electronic device.

The electronic device and the operation method thereof according to various example embodiments transmit user's authentication information to exercise equipment contacted by the user's body through human body communication, such that user authentication on the exercise equipment can be easily performed.

The exercise equipment and the operation method thereof according to various example embodiments perform user authentication based on authentication information provided from an electronic device through human body communication, and detect exercise information of the corresponding user, such that exercise information of the corresponding user can be exactly detected while exactly discriminating a user's exercise time.

The term "module" as used herein may, for example, mean a unit including one of hardware, software, and firmware or a combination of two or more of them. The term "module" may be interchangeably used with, for example, the term "unit", "logic", "logical block", "component", or "circuit". The "module" may be a minimum unit of an integrated component element or a part thereof. The "module" may be a minimum unit for performing one or more functions or a part thereof. The "module" may be mechanically or electronically implemented. For example, the "module" according to the present disclosure may include at least one of an Application-Specific Integrated Circuit (ASIC) chip, a Field-Programmable Gate Arrays (FPGA), and a programmable-logic device for performing operations which are known or are to be developed hereinafter.

According to various example embodiments, at least some of the devices (for example, modules or functions thereof) or the methods (for example, operations) according to the present disclosure may be implemented by a commands or instructions stored in a computer-readable storage medium in a program module form. The commands or instructions, when executed by a processor (e.g., the processor 220 or 420), may cause the one or more processors to execute the function(s) corresponding to the instruction. The computer-readable storage medium may be, for example, the memory 230 or 430.

The computer readable recoding medium may include a hard disk, a floppy disk, magnetic media (for example, a magnetic tape), optical media (for example, a Compact Disc Read Only Memory (CD-ROM) and a Digital Versatile Disc (DVD)), magneto-optical media (for example, a floptical disk), a hardware device (for example, a Read Only Memory (ROM), a Random Access Memory (RAM), a flash memory), and the like. In addition, the program instructions may include high level language codes, which can be executed in a computer by using an interpreter, as well as machine codes made by a compiler. Any of the hardware devices as described above may be configured to work as one or more software modules in order to perform the operations according to various example embodiments of the present disclosure, and vice versa.

Any of the modules or programming modules according to various example embodiments of the present disclosure may include at least one of the above described elements, exclude some of the elements, or further include other additional elements. The operations performed by the modules, programming module, or other elements according to various example embodiments of the present disclosure may be executed in a sequential, parallel, repetitive, or heuristic manner. Further, some operations may be executed according to another order or may be omitted, or other operations may be added.

The example embodiments disclosed herein are provided merely to easily describe technical details of the present disclosure and to help facilitate the understanding of the present disclosure, and are not intended to limit the scope of the present disclosure. Therefore, it will be readily appreciated that all modifications and changes or various other embodiments based on the technical idea of various example embodiments of the present disclosure fall within the scope of the present disclosure.

What is claimed is:

1. An electronic device comprising:

a human body communication circuitry;

a conductive member electrically connected with the human body communication circuitry and exposed for user contact; and at least one processor, wherein the at least one processor is configured to detect contact of a user to the conductive member, to control the human body communication circuitry to transmit at least one piece of user information to an external device through a body of the user, and, when exercise information is received from the external device, to store the exercise information.

2. The electronic device of claim 1, further comprising at least one sensor, wherein the at least one processor is configured to detect, based on the at least one sensor, motion of the electronic device, and, when motion of the electronic device is detected, to control the human body communication circuitry to transmit the at least one piece of user information through the body of the user.

3. The electronic device of claim 1, wherein the at least one processor is configured to, when authentication success information is received through the body of the user which is in contact with the electronic device, set recommended exercise information corresponding to the user, and to control the human body communication circuitry to transmit the recommended exercise information to the external device through the body of the user.

4. The electronic device of claim 3, wherein the at least one processor is configured to set the recommended exercise information corresponding to the user based on at least one of the user information and an exercise history.

5. The electronic device of claim 1, wherein the at least one processor is configured to periodically receive the exercise information through the body of the user.

6. The electronic device of claim 1, further comprising a short range communication module, wherein the at least one processor is configured to receive exercise information from the external device via the short range communication module.

7. The electronic device of claim 1, further comprising a display, wherein the at least one processor is configured to control the display to display information based on the received exercise information.

8. The electronic device of claim 1, wherein the electronic device comprises a wearable device.

9. An operation method of an electronic device, the method comprising:

detecting a user's contact to a conductive member of the electronic device exposed for user content;

transmitting at least one piece of user information to an external device through a body of the user that is in contact with conductive member of the electronic device;

receiving exercise information from the external device; and storing the exercise information.

10. The method of claim 9, wherein transmitting the user information comprises:

detecting motion of the electronic device; and when motion of the electronic device is detected, transmitting the at least one piece of user information through the body of the user.

11. The method of claim 9, further comprising:

when authentication success information is received through the body of the user that is in contact with the conductive member electronic device, setting recommended exercise information corresponding to the user; and transmitting the recommended exercise information to the external device through the body of the user.

12. The method of claim 11, wherein setting the recommended exercise information comprises setting the recommended exercise information corresponding to the user based on at least one of the user information and an exercise history.

13. The method of claim 9, wherein receiving the exercise information comprises periodically receiving the exercise information from the external device through the body of the user.

14. The method of claim 9, further comprising receiving exercise information from the external device through wireless communication.

15. The method of claim 9, wherein outputting the exercise information comprises displaying information based on the received exercise information on a display electrically connected with the electronic device.

16. Exercise equipment comprising:

at least one sensor;

human body communication circuitry;

a conductive member electrically connected with the human body communication circuitry and exposed for user contact; and at least one processor, wherein the at least one processor is configured to detect contact of a user to the conductive member, to receive at least one piece of user information from an external device through a body of the user using the human body communication circuitry, and, when the user is authenticated based on the at least one piece of user information of the external device, to collect exercise information of the user through the at least one sensor.

17. The exercise equipment of claim 16, wherein the at least one processor is configured to set the exercise equipment to correspond to recommended exercise information when the recommended exercise information is received through the body of the user.

18. The exercise equipment of claim 16, wherein the at least one processor is configured to, when the user is authenticated, set recommended exercise information corresponding to the user based on at least one of the user information and an exercise history, and to set the exercise equipment to correspond to the recommended exercise information.

19. The exercise equipment of claim 16, wherein the at least one processor is configured to detect whether the exercise of the user on the exercise equipment is finished based on at least one of contact information of the user through the conductive member and driving information of the exercise equipment.

20. The exercise equipment of claim 16, wherein the human body communication module is attachable to and detachable from the exercise equipment.

* * * * *